US008931497B2

(12) United States Patent
Lee

(10) Patent No.: US 8,931,497 B2
(45) Date of Patent: Jan. 13, 2015

(54) UMBRELLA RIB ASSEMBLY AND FOLDABLE UMBRELLA

(76) Inventor: Boo Il Lee, Busan (KR)

( * ) Notice: Subject to any disclaimer, the term of this patent is extended or adjusted under 35 U.S.C. 154(b) by 1 day.

(21) Appl. No.: 13/517,030

(22) PCT Filed: Dec. 15, 2010

(86) PCT No.: PCT/KR2010/008979

§ 371 (c)(1),
(2), (4) Date: Jun. 18, 2012

(87) PCT Pub. No.: WO2011/074875

PCT Pub. Date: Jun. 23, 2011

(65) Prior Publication Data

US 2012/0266928 A1 Oct. 25, 2012

(30) Foreign Application Priority Data

Dec. 16, 2009 (KR) ..... 10-2009-0125585

(51) Int. Cl.
*A45B 19/10* (2006.01)
*A45B 25/02* (2006.01)

(52) U.S. Cl.
CPC ..... *A45B 19/10* (2013.01); *A45B 25/02* (2013.01)
USPC ..... 135/25.33; 135/25.34

(58) Field of Classification Search
USPC ..... 135/25.2, 25.34, 25.33, 323, 25.3, 32
See application file for complete search history.

(56) References Cited

U.S. PATENT DOCUMENTS

| | | | | | |
|---|---|---|---|---|---|
| 580,159 | A | * | 4/1897 | Ladewig | 135/25.2 |
| 1,249,007 | A | * | 12/1917 | Block | 135/25.3 |
| 1,447,815 | A | * | 3/1923 | Pedersen | 135/25.3 |
| 1,555,568 | A | * | 9/1925 | Gustafson | 135/25.3 |

(Continued)

FOREIGN PATENT DOCUMENTS

| | | |
|---|---|---|
| JP | 2003-0135117 | 5/2003 |
| KR | 20-0172828 | 12/1999 |
| KR | 20-0437933 | 1/2008 |
| KR | 10-2011-0026833 | 3/2011 |

OTHER PUBLICATIONS

International Search Report for PCT/KR2010/008979 mailed Sep. 27, 2011.

*Primary Examiner* — Noah Chandler Hawk
(74) *Attorney, Agent, or Firm* — Revolution IP, PLLC

(57) ABSTRACT

An umbrella rib assembly including a plurality of main ribs hinged at a main rib fixing member fixed at a top of an umbrella shaft, a plurality of a first auxiliary ribs hinged at a first auxiliary rib fixing member fixed at the umbrella shaft at a position lower than the main rib fixing member and connected with the main ribs, a plurality of second auxiliary ribs hinged at a second auxiliary rib fixing member coupled to the umbrella shaft and slidably movable between the main rib fixing member and the second auxiliary rib fixing member. The umbrella rib assembly is unfolded when the second auxiliary rib fixing member descends toward the fixed first auxiliary rib fixing member while the umbrella rib assembly is folded when the second auxiliary rib fixing member ascends toward the fixed main rib fixing member.

2 Claims, 17 Drawing Sheets

(56) References Cited

U.S. PATENT DOCUMENTS

| | | | | | |
|---|---|---|---|---|---|
| 3,457,931 | A | * | 7/1969 | Shimizu | 135/25.3 |
| 3,853,135 | A | * | 12/1974 | Schafer | 135/25.3 |
| 4,077,420 | A | * | 3/1978 | Schultes et al. | 135/25.3 |
| 4,077,421 | A | * | 3/1978 | Schultes et al. | 135/25.3 |
| 4,080,976 | A | * | 3/1978 | Hirai | 135/25.3 |
| 4,105,039 | A | * | 8/1978 | Schultes et al. | 135/25.33 |
| 5,211,199 | A | * | 5/1993 | Seidel et al. | 135/24 |
| 5,740,824 | A | * | 4/1998 | Tang | 135/28 |

* cited by examiner

UMBRELLA RIB ASSEMBLY AND FOLDABLE UMBRELLA

RELATED APPLICATIONS

This application is a 371 application of International Application No. PCT/KR2010/008979, filed Dec. 15, 2010, which in turn claims priority from Korean Patent Application No. 10-2009-0125585, filed Dec. 16, 2009, each of which is incorporated herein by reference in its entirety.

TECHNICAL FIELD

The preset invention relates to a telescopic umbrella rib assembly and an umbrella and in particular to a telescopic umbrella rib assembly and an umbrella which can be easily folded and unfolded and has a minimized length when it is folded, so it is easy to store the umbrella.

BACKGROUND ART

When it rains, people generally use an umbrella for the purpose of protecting their bodies from rain. As one of the umbrellas which are widely used, there is a telescopic umbrella which can be folded from a state of a lengthy umbrella and can be stored in a bag or something, thus providing a good is storage.

The lengthy umbrella and the telescopic umbrella are advancing to have a structure allowing an umbrella rib assembly is unfolded as a user simply pushes a button provided at a grip engaged to a lower end of an umbrella shank, the construction of which is provided for a user to have convenience.

The lengthy umbrella and the telescopic umbrella are unfolded as a user holds and pulls down, with a hand, an auxiliary rib fixing member below an umbrella shank, which auxiliary rib fixing member is positioned at top of an umbrella shank when a user folds an umbrella after a use of it.

The above mentioned procedure might provide a user with a lot of inconvenience when in use, and in particular a user's body or clothes might be wet by the rain water stuck on an umbrella cloth which is tied to an outer circumference of an umbrella rib during the operation of an umbrella.

As a means for the purpose of resolving the above mentioned problems, the same applicant of the present invention filed a few patent applications in relation with a lengthy umbrella; however the applicant has failed to substantially resolve the problems generally encountered in a conventional telescopic umbrella.

After long research and development, the same applicant as the present invention filed a patent application (10-2009-0084644) on an umbrella rib assembly and a telescopic umbrella.

The above mentioned previous application of the umbrella rib assembly and the telescopic umbrella using the same comprises an inner side member one of which is rotatably engaged to a main rib fixing member in a circumferential shape; an intermediate member one end of which is pinned at a portion slightly higher than the other end of the inner side member; a plurality of main ribs which are assembled for the outer side members pinned to the other end of the intermediate member to be folded; a plurality of first auxiliary ribs which are constituted in such a way that one end of which is rotatably engaged to the first auxiliary rib fixing member in a circumferential shape, and the end of the inner side member is rotatably pinned at the intermediate portion to be parallel with the intermediate member of the main rib, and the other end is rotatably pinned at a lower, upper side of the outer side member rotatably engaged to the intermediate end; and a plurality of second auxiliary ribs which are constituted in such a way that one end of each of them is rotatably engaged in a circumferential shape to a second auxiliary rib fixing member positioned between the main rib fixing member and the first auxiliary rib fixing member, and the other end of each of them is rotatably pinned at a portion where the intermediate portion between the inner side member and the first auxiliary rib is engaged, and the diameter of the engaging part in which the inner side member of the main rib is rotatably engaged to the main rib fixing member is larger than the diameter of the engaging part in which the second auxiliary rib is rotatably engaged to the second auxiliary rib fixing member, and the umbrella rib assembly is unfolded by pulling down the second auxiliary rib fixing member and is folded by pushing up the same.

The above described previous application has advantages in that it is possible to unfold and fold an umbrella within a shorter stroke distance from a grip which enhances the convenience and reliable operations when in use, and it is possible to easily unfold and fold an umbrella with small force.

However, the above described conventional telescopic umbrella has a limit in shortening the length of it in a state that the umbrella rib assembly is folded.

A new telescopic umbrella, the umbrella rib assembly can be folded in multiple stages is developed and is being used; however there is a limit in terms of the size of an umbrella cloth, and the umbrella rib assembly is complicated, and it needs a lot of force when unfolding and folding the umbrella, and the umbrella is easily broken down, thus lowering the functionality of the umbrella. So, it is urgently needed to develop a new umbrella rib assembly and a telescopic umbrella which make it possible to unfold an umbrella cloth in a large size and to have a shorter construction when it is folded.

<Prior Art Technology Information>

Korean patent application 10-2009-0084644

DISCLOSURE OF INVENTION

Accordingly, the inventor of the present application has developed a new invention which can resolve the problems encountered in the conventional umbrella rib assembly and telescopic umbrella, and it is an object of the present invention to provide a telescopic umbrella rib assembly and an umbrella which make it possible to easily unfold and fold and to minimize the length of an umbrella when it is folded, thus obtaining an easier storage of an umbrella.

To achieve the above objects, there is provided an umbrella rib assembly of a telescopic type construction which is formed of a foldable main rib, a first auxiliary rib and a second auxiliary rib, comprising an inner side member one side of which is rotatably engaged by means of a pin at the main rib fixing member in a circumferential shape; an intermediate member one side of which is engaged by means of a pin at a portion higher than the other side of the inner side member; a plurality of main ribs which are assembled to the other side of the intermediate member by means of a pin in such a way to fold an outer side member; a support member one side of which is engaged by means of a pin at the first auxiliary rib fixing member in a circumferential shape; a plurality of first auxiliary ribs which are assembled to fold a connection member one side of which is engaged by means of a pin at the other side of the support member, with the end of the inner side member being rotatably engaged by means of a pin at an outer side of the end at the side engaged with the support member in such a way to be parallel with the intermediate member of the main rib, and the other side of which is rotatably connected by means of a pin to an upper, lower side of the outer side member 113 connected with the intermediate member; and a second auxiliary rib one side of which is rotatably engaged by means of a pin in a circumferential shape at the second auxiliary rib fixing member disposed between the main rib fixing member and the first auxiliary rib fixing member, and the other side of which is rotatably engaged by means of a pin at the engaging portion of the inner side member 111 and the connection member of the first auxiliary rib, wherein the diameter D1 of the engaging part in which the inner side member of the main rib 110 is rotatably engaged to the main rib fixing member is larger than the diameter D2 of the engaging part in which the second auxiliary rib is rotatably engaged to the second auxiliary rib fixing member, so when the second auxiliary rib fixing member 160 descends toward the fixed first auxiliary rib fixing member 150, the umbrella rib assembly 100 is unfolded, and when it ascends toward the fixed main rib fixing member, 140 the umbrella rib assembly 100 is folded.

In the present invention, various telescopic umbrellas using the umbrella rib assembly can be automatically or manually unfolded and folded.

Advantageous effects

The umbrella rib assembly and telescopic umbrella according to the present invention has the following effects when in use.

It is easy to store since the length of the umbrella is short in a state that an umbrella rib assembly is folded.

It is easy to unfold and fold the umbrella.

As compare with the conventional telescopic umbrella, since the surface area of an umbrella cloth is large, it is possible to protect a users body from rain water in safe.

Figure 1:
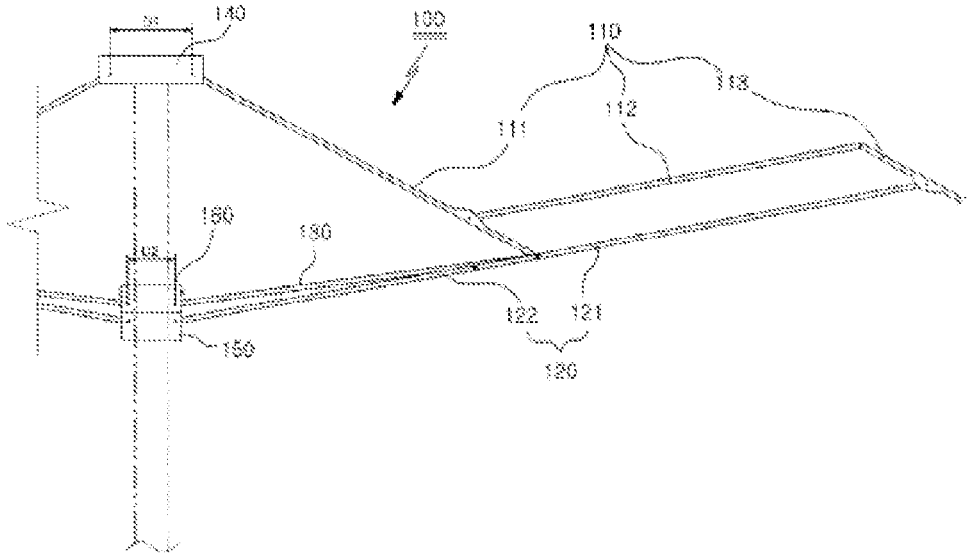
FIG. 1 is a cross sectional view illustrating a construction of an umbrella rib assembly when an umbrella rib assembly is unfolded according to a preferred embodiment of the present invention.

<Descriptions of reference numerals used for the key elements of the drawings>

| | |
|---|---|
| 100: umbrella rib assembly | 110: main rib |
| 111: inner side member | 112: intermediate member |
| 113: outer side member | 120: first auxiliary rib |
| 121: connection member | 122: support member |
| 130: second auxiliary rib | 140: main rib fixing member |
| 150: first auxiliary rib fixing member | 160: second auxiliary rib fixing member |
| 1: (telescopic) umbrella | 2: grip |
| 3: lower tube | 3a: slanted surface |
| 3b: hole | 4: upper tube |
| 4a: fixing hole | 4b: operation elongated hole |
| 4c: fixing hole | 5: umbrella shank |
| 6: expanded engaging shoulder | 7: operation tube |
| 7a, 7b, 7d, 7e, 7g: engaging holes | 7c, 7f: fixing holes |
| 8: contracted engaging shoulder | 9: plate spring |
| 10: latch | 10a: hole |
| 11: L-shaped rotation member | 12: L-shaped button |
| 13: wire | 14: operation handle |
| plate spring | 16: fixer |
| 17: pin | 18, 18', 19: contracted engaging shoulders |
| 20: spring | 21: button |
| 22: spring fixture | 23: spring support |
| 24: compression spring | 25: tensional spring |
| 26: compression spring | 27: auxiliary operation tube |
| 27a: engaging rod | 27b: engaging groove |
| 27c: expanded engaging shoulder | 27d: contracted engaging shoulder |
| 28: guide member | 28a: insertion hole |
| 28b: cut-away part | 29, 30, 31: rotation hole |
| 32: rotation part | 32a: engaging protrusion |
| 32b: spring | 33: pin |
| 34: straight line-shaped rotation member | |
| 35: pin | |
| 36: plate spring | 36a: support shoulder |
| 37: engaging protrusion part | 38: rotation lever |
| 39: plate spring | 40: engaging part |
| 41: protrusion | 42: engaging protrusion |
| 43: first compression spring | 44: second compression spring |
| 45: contracted engaging shoulder | |

MODES FOR CARRYING OUT THE INVENTION

The constructions of the umbrella rib assembly and the telescopic umbrella according to the present invention will be described with reference to the accompanying drawings.

Figure 2:
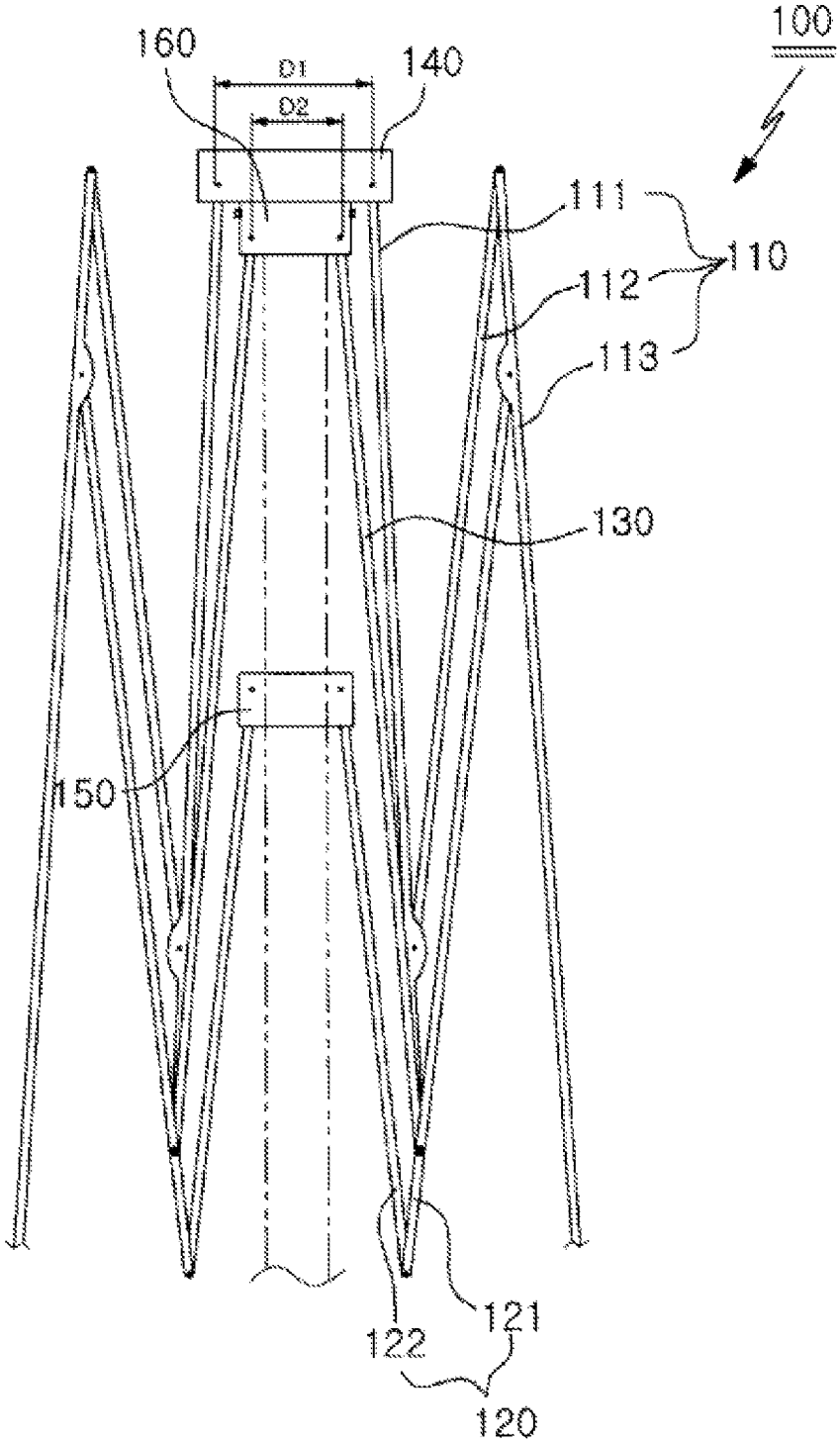
FIG. 2 is a cross sectional view illustrating a construction of an umbrella rib assembly when an umbrella rib assembly is folded according to a preferred embodiment of the present invention.

FIG. 1 is a cross sectional view illustrating a construction of an umbrella rib assembly when an umbrella rib assembly is unfolded according to a preferred embodiment of the present invention. FIG. 2 is a cross sectional view illustrating a construction of an umbrella rib assembly when an umbrella rib assembly is folded according to a preferred embodiment of the present invention.

The umbrella rib assembly 100 according to the present invention comprises a plurality of main ribs 110 formed of an inner side member 111, an intermediate member 112 and an outer side member 113 which are foldable, a plurality of first auxiliary ribs 120 formed of support members 122 in such a way to be foldable with a connection member 121 pinned to the inner side member 111 and the outer side member 113 to be parallel with the intermediate member 112 of the main rib 110, and a plurality of second auxiliary ribs 130 which are engaged to the engaged portion of the inner side member 111 and the connection member 121 of the first auxiliary rib 120.

In other words, there are provided an inner side member 111 one end of which is rotatably pinned at the main rib fixing member 140 in a circumferential shape; an intermediate member 112 one end of which is pinned at a portion higher than the other end of the inner side member 111; a plurality of main ribs 110 assembled to fold the outer side member 113 pinned at the other end of the intermediate member 112; a support member 122 one end of which is rotatably pinned at the first auxiliary rib fixing member 150 in a circumferential shape; a plurality of first auxiliary ribs 120 assembled to fold the connection member 121 one end of which is pinned at the other end of the support member 122, and an end of the inner side member 111 is rotatably pinned at an outer side of the end in the side engaged with the support member 122 in such a way to be parallel with the intermediate member 112 of the main rib 110, and the other end of which is rotatably pinned at an upper, lower side of the outer side member 113 connected with the intermediate member 112; and a second auxiliary rib 130 one end of which is rotatably pinned at the second auxiliary rib fixing member 160, in a circumference shape, positioned between the main rib fixing member 140 and the first auxiliary rib fixing member 150, and the other end of which is rotatably pinned at the engaging portion of the inner side member 111 and the connection member 121 of the first auxiliary rib 120.

In addition, the diameter D1 of the engaging part in which the inner side member 111 of the main rib 110 is rotatably engaged at the main rib fixing member 140 is larger than the diameter D2 of the engaging part in which the second auxiliary rib 130 is rotatably engaged at the second auxiliary rib fixing member 160.

As the diameter D1 of the engaging part in which the inner side member 111 of the main rib 110 is engaged, increases more than the diameter D2 of the engaging part to which the second auxiliary rib 130 is engaged, it becomes possible to more easily unfold and fold the umbrella rib assembly 100 with smaller force.

As for the use of the umbrella rib assembly 100 according to the present invention, as compared with the conventional umbrella rib assembly in which the umbrella 1 is unfolded by pushing up the auxiliary rib fixing member and is folded by pulling down the same, in the present invention, the umbrella rib assembly 100 is unfolded by pulling down the second auxiliary rib fixing member 160 positioned between the main rib fixing member 140 fixed at the umbrella shank and the first auxiliary rib fixing member 150, and the umbrella rib assembly 100 can be folded by pushing up the same, and the umbrella cloth with a wider surface area can be engaged by elongating the length of each member of the main rib 110.

The above described construction is provided for the purpose of unfolding and folding the umbrella rib assembly 100 with a small force with the aid of a short stroke distance.

The umbrella rib assembly 100 according to the present invention is constituted in such a way that the first auxiliary rib 120 is formed of a support member 122 and a connection member 121 the construction of which helps elongate longer the length of the main rib 110 to which an umbrella cloth is engaged as compared with the conventional umbrella while minimizing the length of the umbrella 1 in a folded state since the umbrella 1 can be unfolded and folded in a state that the first auxiliary rib fixing member 150 to which the first auxiliary rib 120 is engaged, is fixed at the umbrella shank.

Figure 3:
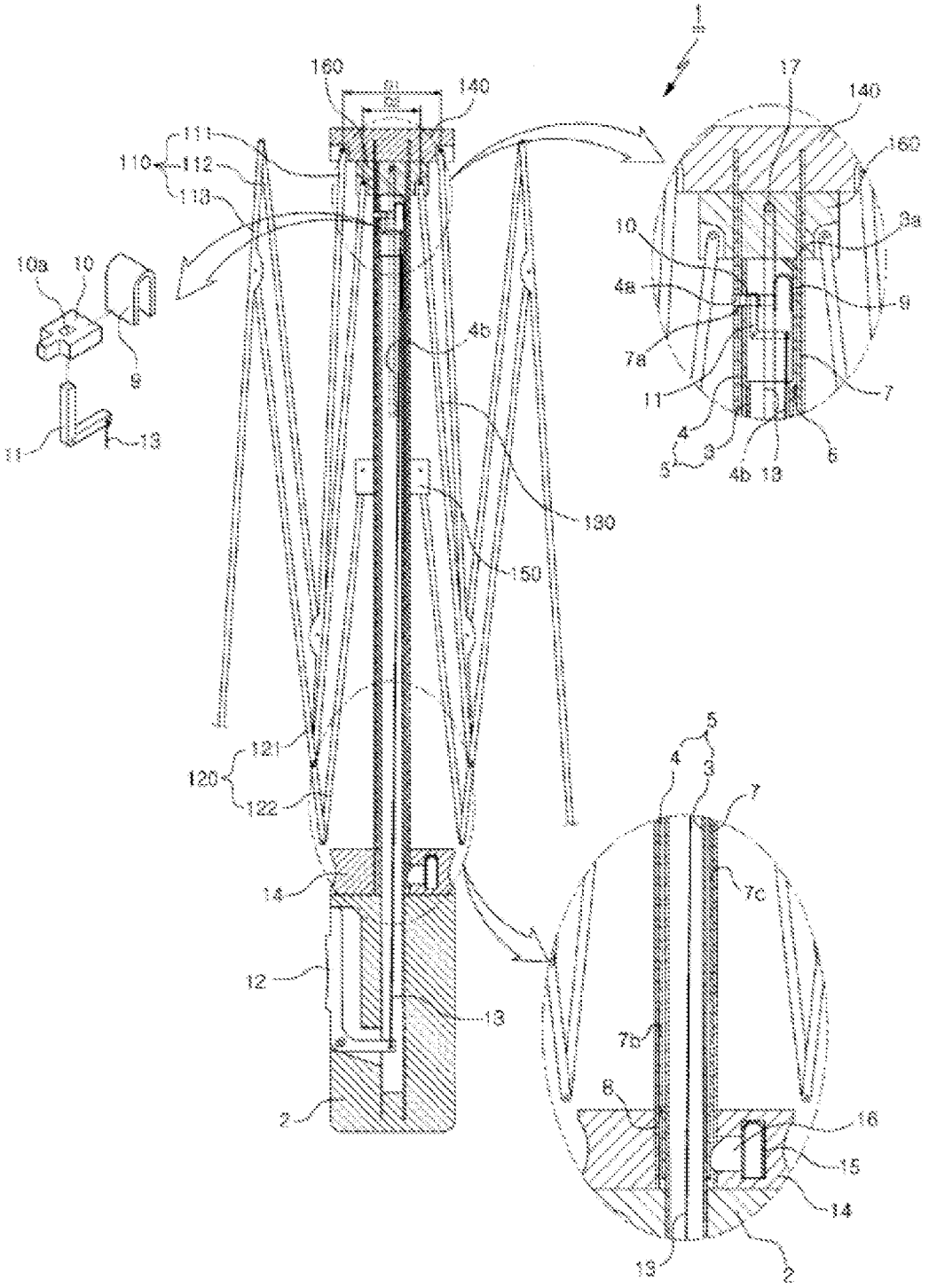
FIG. 3 is a cross sectional view illustrating a state that a telescopic umbrella is folded according to a first embodiment of the present invention.
Figure 4:
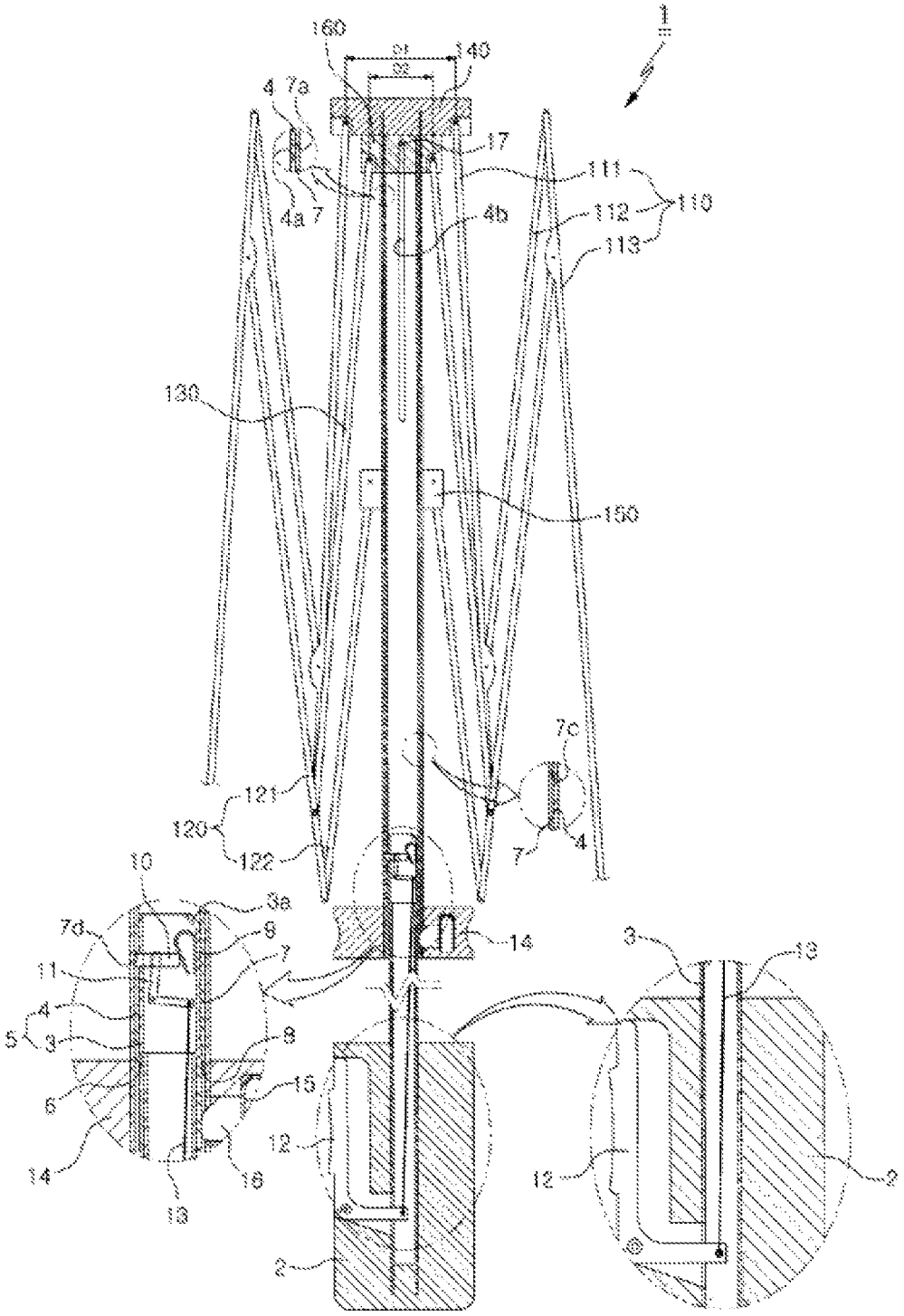
FIG. 4 is a view illustrating a state that an umbrella shank is drawn out in a state that a telescopic umbrella rib assembly is folded according to a first embodiment of the present invention.
Figure 5:
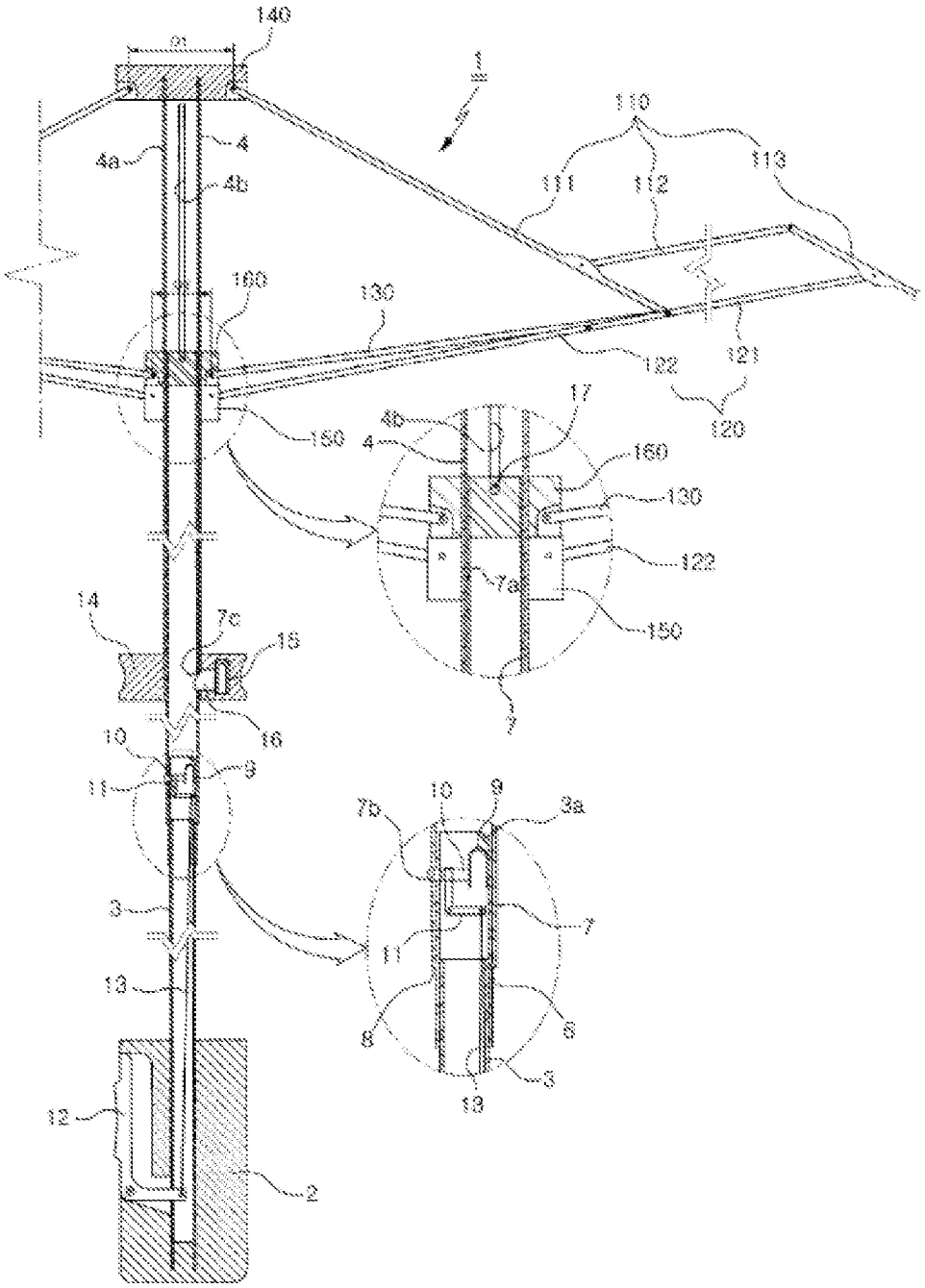
FIG. 5 is a cross sectional view illustrating a state that a telescopic umbrella is unfolded according to a first embodiment of the present invention.

FIG. 3 is a cross sectional view illustrating a state that a telescopic umbrella is folded according to a first embodiment of the present invention. FIG. 4 is a view illustrating a state that an umbrella shank is drawn out in a state that a telescopic umbrella rib assembly is folded according to a first embodiment of the present invention. FIG. 5 is a cross sectional view illustrating a state that a telescopic umbrella is unfolded according to a first embodiment of the present invention.

The telescopic umbrella 1 according to a first embodiment of the present invention is constituted to allow the umbrella 1 to be unfolded and folded in a manual way. As shown in the above drawings, in the inside of the operation tube 7 with the contracted engaging shoulder 8 at its lower end is slide-inserted the lower tube 3 the lower end of which is fixedly engaged to the grip 2, and at the upper side of which is formed the expanded engaging shoulder 6, and at the one side of the upper end of which is formed a slanted surface 3*a*. With the above construction, the expanded engaging shoulder 6 of the lower tube 3 is caught by the contracted engaging shoulder 8 of the operation tube 7, and the upper tube 4 longer than the operation tube 7 is slide-assembled at the outer side of it, thus consequently forming the umbrella shank 5.

In the interior of the upper side of the expanded engaging shoulder 6 of the upper side of the lower tube 3 is installed the latch 10 supported by the plate spring 9, and the latch 10 is inserted into the fixing hole 4*a* of the upper side of the upper tube 4 via the engaging hole 7*a* formed at the upper side of the operation tube 7 in a state that the umbrella 1 is folded. In a state that the umbrella 1 is unfolded, it is inserted into the engaging hole 7*b* formed at above the contracted engaging shoulder 8 of the lower side of the operation tube 7.

The latch 10 is installed to operate by the L-shaped button 12 rotatably installed at the grip 2. The construction of it will be described. The L-shaped rotation member 11 is rotatably pinned at the upper side of the lower tube 3, the one end of the L-shaped rotation member 11 being inserted into the hole 10*a* formed at the latch 10 so that the latch 10 can move toward the plate spring 9. The end of the other side of the L-shaped rotation member is connected with the L-shaped button 12 by way of the wire 13, so when the L-shaped button 12 is pushed, the latch 10 operates in sync with it, so it can be inserted into the interior of the lower tube 3 while pressurizing the plate spring 9.

At the lower side of the upper tube 4 is fixed the operation grip 14. The fixing member 16 supported by the plate spring 15 is inwardly installed at the operation grip 14, and the fixing member 16 is inserted into the fixing hole 7*c* formed below the operation tube 7 in a state that the umbrella shank 5 is extended, which makes the umbrella rib assembly 100 remain in a unfolded state. At this time, the fixing hole 7*c* formed at the operation hole 7*c* formed at the operation tube 7 is formed a little higher than the engaging hole 7*b* formed just above the contracted engaging shoulder 8 of the lower side of the operation tube 7, thus matching with the moving distance of the second auxiliary rib fixing member 160 which will be described later.

At the upper side of the upper tube 4 forming the umbrella shank 5 is installed the umbrella rib assembly 100 according to the present invention. The construction of it will be described. At the upper side of the upper tube 4 is fixedly installed the main rib fixing member 140 to which the inner member 111 of the main rib 110 is rotatably engaged, and the first auxiliary rib fixing member 150 to which the support member 122 of the first auxiliary rib 120 is rotatably engaged, is fixedly installed at the outer side of the upper tube 4 of the lower side of it, and the second auxiliary rib fixing member 160 to which the second auxiliary rib 130 is rotatably engaged is installed between the main rib fixing member 140 and the first auxiliary rib fixing member 150 in such a way to slide-move along the upper tube 4. With the above construction, when the second auxiliary rib fixing member 160 descends toward the first auxiliary fixing member 150, the umbrella rib assembly 100 is unfolded, and when the second auxiliary rib fixing member 160 ascends upward the main rib fixing member 140, the umbrella rib assembly 100 is folded.

In addition, at the upper tube 4 is formed the operation elongated hole 4*b* being opposite to it and being formed as much as the ascent and descent width of the second auxiliary rib fixing member 160, and the second auxiliary rib fixing member 160 is assembled to the upper side of the operation tube 7 by way of the pin 17 via the operation elongated hole 4*b*, thus allowing it to slide-move along the upper tube 4.

The examples of the operation of the telescopic umbrella 1 according to a first embodiment of the present invention will be described.

When it is needed to unfold the umbrella 1 in a state that the umbrella 1 is folded as shown in FIG. 3, the operation grip 14 engaged to the lower side of the upper tube 4 is held by a hand in a state that the L-shaped button 12 installed at the grip 2 is pressurized, and the grip 2 is pulled downward.

In other words, when the L-shaped button 12 is pressurized, the L-shaped rotation member 11 connected with the L-shaped button 12 by way of a wire 13 rotates, and the latch 10 escapes from the fixing hole 4*a* and the engaging hole 7*a* in a state that it is overlapped on the upper sides of the upper tube 4 and the operation tube 7. At this time, when the grip 2 is pulled holding the operation grip 14, the expanded engaging shoulder 6 formed at the upper side of the lower tube 3 is drawn out to the contracted engaging shoulder 8 formed at the lower side of the operation tube 7. In the meantime, the umbrella rib assembly 100 remains in the folded state, and the latch 10 remains contacted in the interior of the upper tube 4 by way of the engaging hole 7*b* above the contracted engaging shoulder 8 of the lower side of the operation tube 7, so the state of FIG. 4 is obtained.

In the above state, the pressurized state of the L-shaped button 12 is released so as to unfold the umbrella rib assembly 100, and when the grip 2 is pulled more, the operation tube 7 is drawn out along with the lower tube 3. At this time, the second auxiliary rib fixing member 160 engaged to the upper side of the operation tube 7 by way of the pin 17 via the operation elongated hole 4*b* moves downward toward the first auxiliary fixing member 150, and the umbrella rib assembly 100 is unfolded. The latch 10 keeping contacted in the interior of the upper tube 4 escapes from the lower side of the upper tube 4 by way of the engaging hole 7*b* formed at above the contracted engaging shoulder 8 of the lower side of the operation tube 7 and protrudes from the outer side of the operation tube 7, so the lower tube 3 and the operation tube 7 are fixedly engaged, and the fixer 16 installed at the operation grip 14 is inserted into the fixing hole 7*c* formed at the lower side of the operation tube 7, so the operation tube 7 and the upper tube 4 are fixedly engaged, so the state of FIG. 5 is obtained, in which the umbrella 1 is fixed in a state that the umbrella 1 is unfolded.

When it is needed to fold the umbrella 1 after it is used, the operation grip 14 is held by a hand with the L-shaped button 12 provided at the grip 2 being pressurized, and the grip 2 is pushed up toward the operation handle 14.

When the L-shaped button 12 provided at the grip 2 is pressurized, the L-shaped rotation member 11 connected with the L-shaped button 12 by way of the wire 13 rotates, and the latch 10 escapes from the engaging hole 7*b* formed at above the contracted engaging shoulder 8 of the lower side of the operation tube 7, so the engagements of the lower tube 3 and the operation tube 7 are disengaged. At this time, when the grip 2 is pushed toward the operation grip 14, the lower tube 3 is inserted into the interior of the operation tube 7, and the slanted surface 3*a* formed at one side of the upper side of the lower tube 3 pushes the lower side of the fixer 16, so the fixer 16 escapes from the fixing hole 7*c* of the operation tube 7, whereby the engagement of the operation tube 7 and the upper tube 4 are disengaged, and as the lower tube 3 continues to insert into the operation tube 7 and moves upward, the upper side of the lower tube 3 pushes the upper side of the operation tube 7, so the second auxiliary rib fixing member 160 engaged with the upper side of the operation tube 7 by way of the pin 17 moves upward toward the main rib fixing member 140, whereby the umbrella rib assembly 100 is folded and at the same time the umbrella shank 5 is folded.

As the upper side of the lower tube 3 and the upper side of the operation tube 7 come into contact and move toward the main rib fixing member 140, when the latch 10 keeping contacted with the interior of the upper tube 4 via the engaging hole 7*a* of the operation tube 7 reaches the fixing hole 4*a* formed at the upper side of the upper tube 4, it protrudes from the fixing hole 4*a*, so the lower tube 3 and the upper tube 4 and the operation tube 7 are concurrently engaged and fixed, whereby the umbrella 1 is folded and fixed as shown in FIG. 3.

In case of the umbrella rib assembly 100 according to the present invention, as mentioned earlier, the diameter D1 of the engaging part to which the main rib 110 is engaged is larger than the diameter D2 of the engaging part to which the second auxiliary rib 130 is engaged, so it is possible to unfold the umbrella rib assembly 100 and to extend the umbrella shank 5 by pulling downward the grip 2 with a small force while holding the operation grip 14 with a hand.

Figure 6:
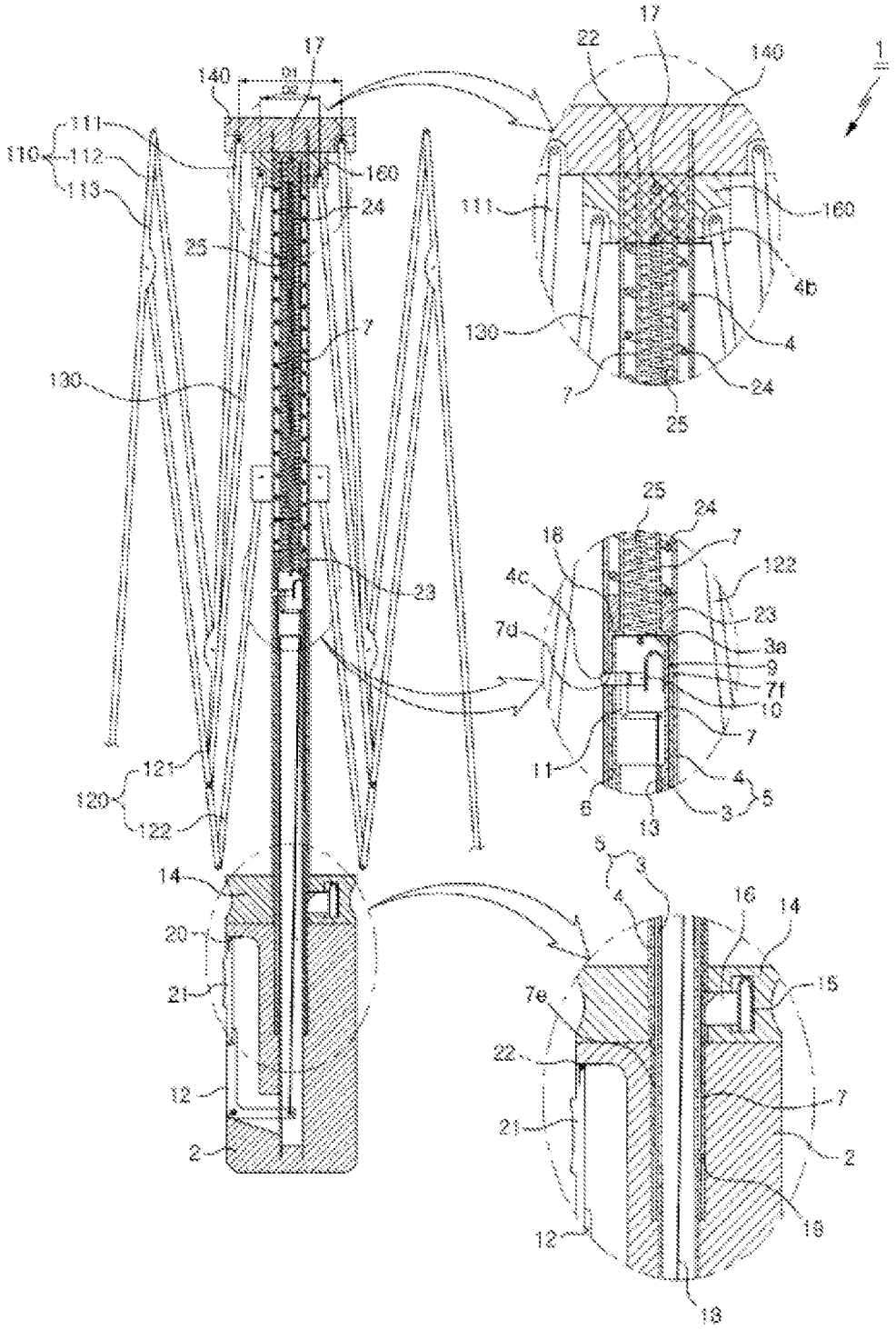
FIG. 6 is a cross sectional view illustrating a state that a telescopic umbrella is folded according to a second embodiment of the present invention.
Figure 7:
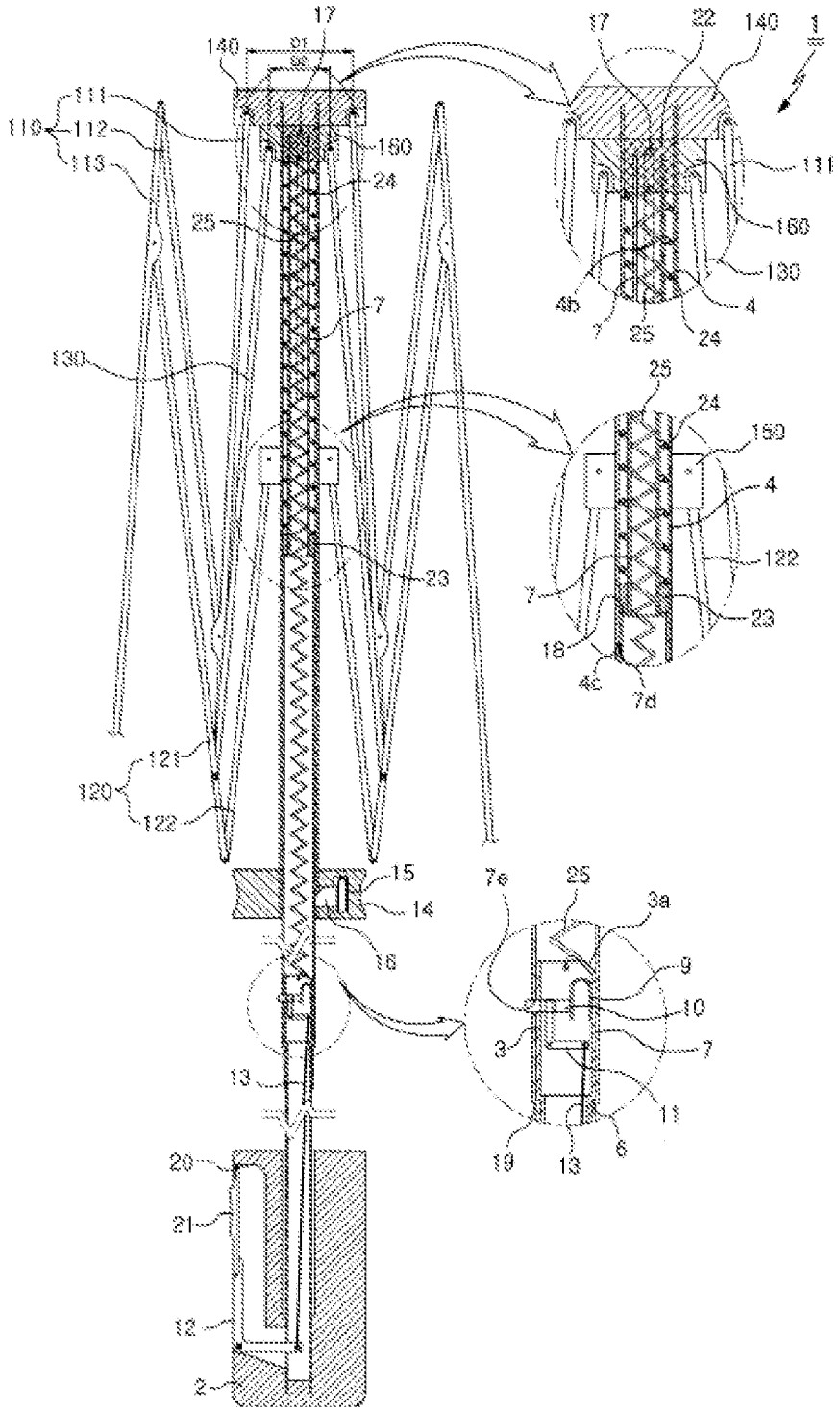
FIG. 7 is a view illustrating a state that an umbrella shank is drawn out in a state that an umbrella rib assembly of an umbrella is folded according to a second embodiment of the present invention.
Figure 8:
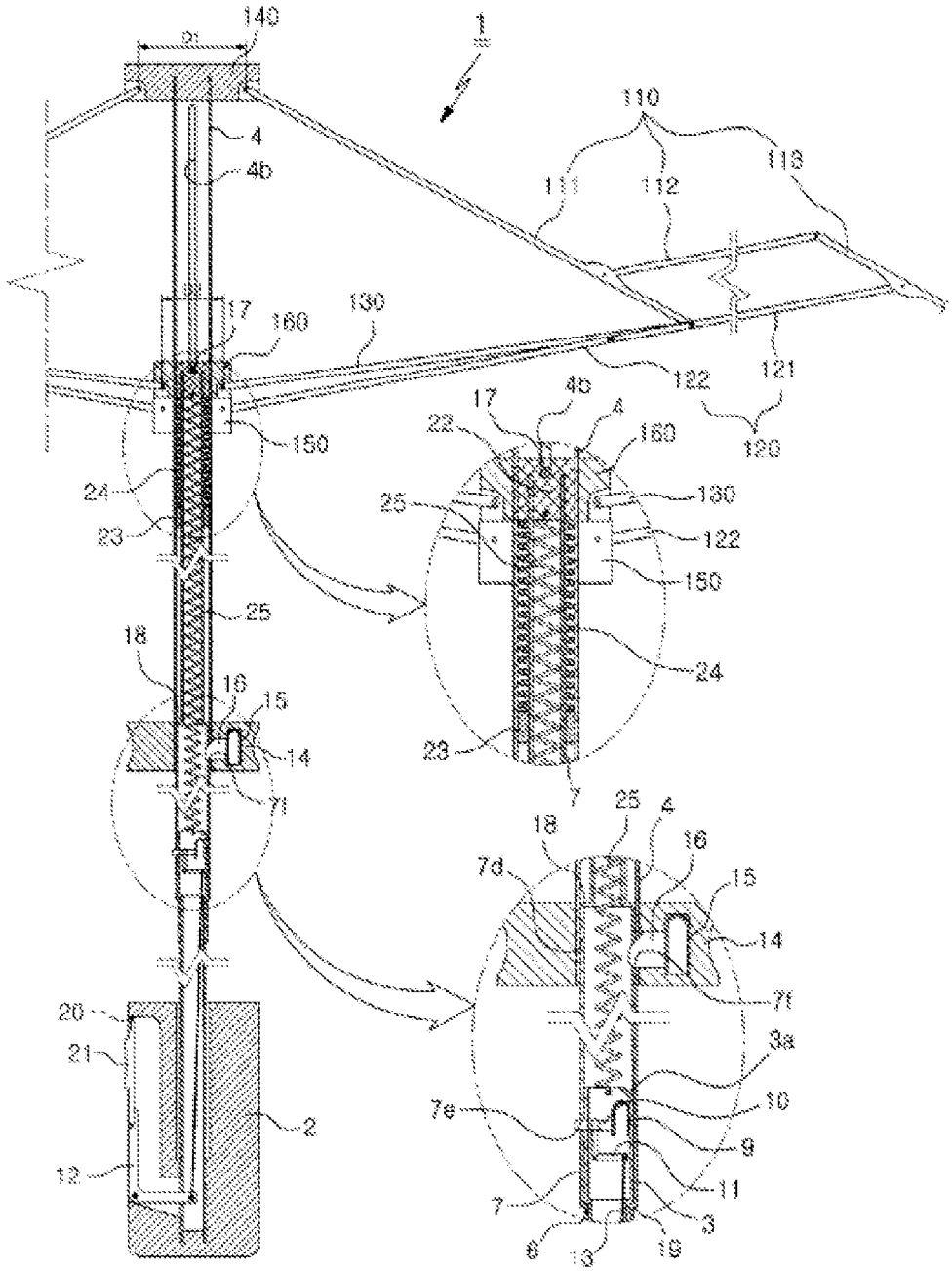
FIG. 8 is a cross sectional view illustrating a state that a telescopic umbrella is unfolded according to a second embodiment of the present invention.

FIG. 6 is a cross sectional view illustrating a state that a telescopic umbrella is folded according to a second embodiment of the present invention. FIG. 7 is a view illustrating a state that an umbrella shank is drawn out in a state that an umbrella rib assembly of an umbrella is folded according to a second embodiment of the present invention. FIG. 8 is a cross sectional view illustrating a state that a telescopic umbrella is unfolded according to a second embodiment of the present invention.

The telescopic umbrella 1 according to the second embodiment of the present invention is directed to that the umbrella 1 is manually unfolded and automatically folded. As shown in the drawings, the umbrella shank 5 is constituted in such a way that the lower side of it is fixedly engaged to the grip 2 in the interior of the operation tube 7 having the contracted engaging shoulders 18 and 19 at the upper, intermediate side and the lower side, respectively, and the lower tube 3 having a sloped surface 3*a* at an upper surface of its one side is slidably inserted, thus allowing the upper side of the lower tube 3 and the expanded engaging shoulder 6 to be caught by means of the contracted engaging shoulders 18 and 19 of the operation tube 7, respectively, and the upper tube shorter than the length of the operation tube 7 is slidably assembled to the outside of it.

In the interior of the upper side of the expanded engaging shoulder 6 of the upper side of the lower tube 3 is installed the latch 10 supported by means of the plate spring 9, and the latch 10 is inserted into the fixing hole 4*c* formed at the intermediate portion of the upper tube 4 via the engaging hole 7*d* formed at below the contracted engaging shoulder 18 of the upper side of the operation tube 7 in a state that the umbrella 1 is folded, and it is inserted in the engaging hole 7*e* formed at the upper side of the contracted engaging shoulder 19 of the lower side of the operation tube 7 in a state that the umbrella 1 is unfolded.

The latch 10 is rotatably installed at the grip 2 and is installed to operate by means of the L-shaped button 12 rotating by the button 21 which recovers by means of the elastic force of the spring 20. As for the construction of it, the L-shaped rotation member 11 one end of which is inserted into the hole 10*a* formed at the latch 10 in order for the latch 10 to move toward the plate spring 9 is assembled to the upper side of the lower tube 3 by way of the pin in a rotatable manner, and the end of the other side of the L-shaped rotation member 11 is connected with the L-shaped button 12 by way of the wire 13, so the latch 10 operates in sync when the button 21 is pressed, whereby it can insert into the interior of the lower tube 3 while pressurizing the plate spring 9.

At the lower end of the upper tube 4 is fixed the operation grip 14, and the fixer 16 supported by the plate spring 15 is installed in the operation grip 14. The fixer 16 is inserted in the fixing hole 7*f* formed at the operation tube 7 in a state that the umbrella shank 5 is unfolded, so the umbrella rib assembly 100 can maintain the unfolded state. At this time, the fixing hole 7*f* formed at the operation tube 7 is formed at a portion opposite to the engaging hole 7*d* formed below the contracted engaging shoulder 18 of the upper side of the operation tube 7, in other words, the fixing hole 7*f* is formed a little lower for the purpose of securing that it can overlap with part of the engaging hole 7*d*, and it is formed a little larger than that the engaging hole 7*d*.

At the upper side of the upper tube 4 is installed the umbrella rib assembly 100 according to the present invention. The construction of it will be described. At the upper side of the upper tube 4 is fixedly installed the main rib fixing member 140 to which the inner member 111 of the main rib 110 is rotatably engaged, and at an outer side of the upper tube 4 of the lower side of it is fixedly installed the first auxiliary rib fixing member 150 to which the support member 122 of the first auxiliary rib 120 is rotatably engaged. The second auxiliary rib fixing member 160 to which the second auxiliary rib 130 is rotatably engaged is installed between the main rib fixing member 140 and the first auxiliary rib fixing member 150 and is slide-movable along the upper tube 4. So, when the second auxiliary rib fixing member 160 descends toward the first auxiliary rib fixing member 150, the umbrella rib assembly 100 is unfolded, and when it ascends toward the main rib fixing member 140, the umbrella rib assembly 100 is folded.

At the upper tube 4 is formed the operation elongating hole 4*b* being opposite to it and being formed as much as the ascent and descent width of the second auxiliary rib fixing member 160. The second auxiliary rib fixing member 160 is assembled along with the spring fixer 22 formed at the upper side of the operation tube 7 by way of the pin 17 via the operation elongating hole 4*b*, so it can slide along the upper tube 4.

The present invention is characterized in that the umbrella 1 can be automatically folded. As a means for implementing it, a spring support 23 is provided at an inner side of the upper tube 4 in the vicinity of the contracted engaging shoulder 18 of the upper side of the operation tube 7 in a state that the umbrella 1 is folded, and the compression spring 24 is disposed between the spring fixer 22 of the upper side of the operation tube 7 and the spring support 23, so both ends of the tensional spring 25 at the spring fixer 22 of the upper side of the operation tube 7 and the upper side of the lower tube 3.

The compression spring 24 and the tensional spring 25 are compressed and extended while the umbrella 1 is being unfolded, thus remaining in the fixed state, and the energies of them are used when folding the umbrella 1.

The operations of the telescopic umbrella 1 according to a second embodiment of the present invention will be described.

First of all, when it is needed to unfold the umbrella 1 in a state that the umbrella 1 is folded as shown in FIG. 6, the grip 2 is pulled downward while holding the operation grip 14, with a hand, engaged to the lower side of the upper tube 4 in a state that the button 21 installed at the grip 2 is pressurized.

As the button 21 is pressurized in the above described manner, the L-shaped button 12 rotates, and the L-shaped rotation member 11 connected with it via the wire 13 rotates, and the latch 10 escapes from the fixing hole 4*c* and the engaging hole 7*d* which are overlapped at the intermediate portions of the upper tube 3 and the operation tube 7. In this state, when the grip 2 is pulled in a state that the operation grip 14 is held, the expanded engaging shoulder 6 formed at the upper side of the lower tube 3 is drawn to the contracted engaging shoulder 19 of the lower side formed at the lower side of the operation tube 7. At this time, the umbrella rib assembly 100 maintains a folded state as shown in FIG. 7.

In the above state, when the pressurizing state on the button 21 is depressurized, the latch 10 formed at the upper side of the lower tube 3 is inserted into the engaging hole 7*e* formed above the contracted engaging shoulder 19 of the lower side of the operation tube 7, and the lower tube 3 and the operation tube 7 are fixedly engaged, and at the same time the tensional spring 25 both end of which are fixed at the spring fixer 22 of the upper side of the operation tube 7 and the upper side of the lower tube 3 is extended and fixed, the extended force of which is used when folding the umbrella shank 5. During the above mentioned operations, the operation tube 7 a little moves downward by means of the tensional force of the tensional spring 25, so the second umbrella rib fixing member 160 moves downward, and the umbrella rib assembly 100 is a little unfolded.

In the above state, it is needed to pull the grip 2 more in order to unfold the umbrella rib assembly 100.

In other words, when the grip 2 is pulled more, the operation tube 7 is drawn out along with the lower tube 3. At this time, the second auxiliary rib fixing member 160 engaged with the spring fixer 22 of the upper side of the operation tube 7 by way of the pin 17 moves downward toward the first auxiliary rib fixing member 150, so the umbrella rib assembly 100 is unfolded, and the fixer 16 installed at the operation grip 14 of the lower side of the upper tube 4 is inserted into the fixing hole 7*f* formed below the contracted engaging solder 18 of the upper side of the operation tube 7, and the upper tube 4 and the operation tube 7 are fixedly engaged, and the state that the umbrella 1 is unfolded is obtained as shown in FIG. 8. At this time, the compression spring 24 disposed between the spring fixer 22 of the upper side of the operation tube 7 and the spring support 23 is compressed and fixed and used when the umbrella rib assembly 100 is folded. When the compression spring 24 is compressed, there is no change in the length of the tensional spring 25.

When it is needed to fold the umbrella 1 after it is used in a state that the umbrella 1 is unfolded, the button 21 is pressurized, thus automatically folding the umbrella 1.

According to the second embodiment of the present invention, when the button 21 installed at the grip 2 is pressurized, the L-shaped rotation member 11 connected with the L-shaped button 12 via the wire 13 rotates, so the latch 10 escapes from the engaging hole 7*e* formed just above the contracted engaging shoulder 19 of the lower side of the operation tube 7.

When the latch 10 escapes from the engaging hole 7*e*, the engagement of the lower tube 3 and the operation tube 7 is disengaged, and the lower tube 3 is inserted into the interior of the operation tube 7 fixed at the upper tube 4 by means of a recovery force of the tensional spring 25 both ends of which are fixed at the spring fixer 22 of the upper side of the operation tube 7 and the upper side of the lower tube 3, and the slanted surface 3*a* formed at one side of the upper side of the lower tube 3 pushes the lower side of the fixer 16 of the operation grip 14 fixed at the lower side of the upper tube 4, so it escapes from the fixing hole 7*f* formed just below the contracted engaging shoulder 18 of the upper side of the operation tube 7, thus disengaging the engagement of the operation tube 7 and the upper tube 4, and the upper side of the lower tube 3 comes into contact with the contracted engaging shoulder 18 of the upper side of the operation tube 7, and at the same time the compression spring 24 disposed between the spring fixer 22 of the upper side of the operation tube 7 and the spring support 23 expands, and then the operation tube 7 ascends, and allows the second auxiliary rib fixing member 160 assembled to the spring fixer 22 of the operation tube 7 by way of the pin 17 via the operation elongating hole 4*b* to ascend toward the main rib fixing member 140, so the umbrella rib assembly 100 is folded, and the umbrella shank 5 is folded.

In a state that the umbrella 1 is fully folded as the operation tube 7 ascends, the latch 10 of the upper side of the lower tube 3 is inserted into the fixing hole 4*c* formed at the intermediate portion of the upper tube 4 via the engaging hole 7*d* formed below the contracted engaging shoulder 18 of the upper side of the operation tube 7, and the lower tube 3 and the upper tube 4 and the operation tube 7 all are concurrently engaged and fixed, so the state that the umbrella 1 is fully folded as shown in FIG. 6 is obtained.

In case of the umbrella rib assembly 100 according to the present invention, since the diameter D1 of the engaging part to which the main rib 110 is engaged as mentioned earlier is larger than the diameter D2 of the engaging part to which the second auxiliary rib 130 is engaged, it is possible to unfold the umbrella rib assembly 100 or to expand the umbrella shank 5 by pulling downward the grip 2 with a small force with the hand holding the operation grip 14.

Figure 9:
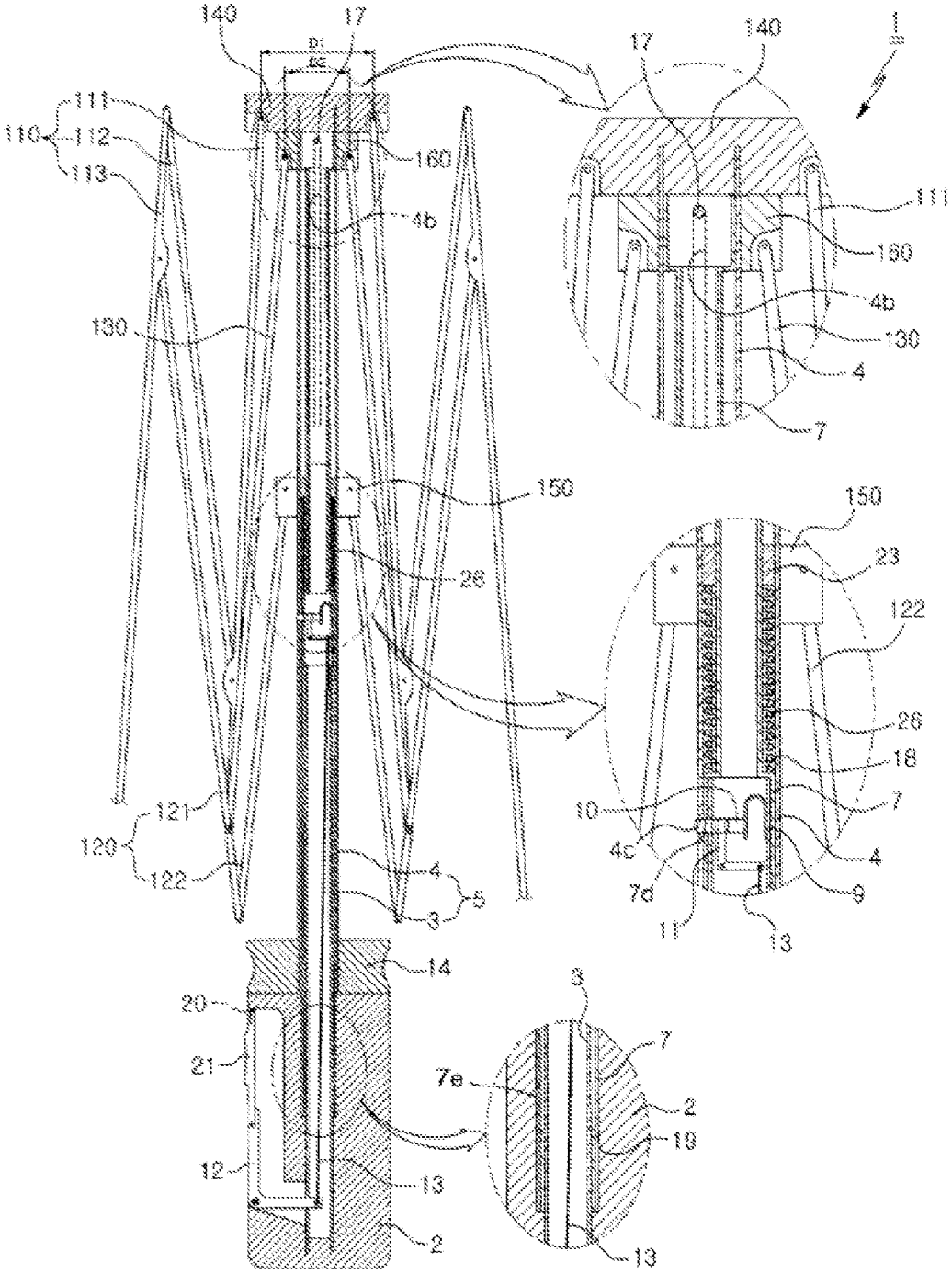
FIG. 9 is a cross sectional view illustrating a state that a telescopic umbrella is folded according to a third embodiment of the present invention.
Figure 10:
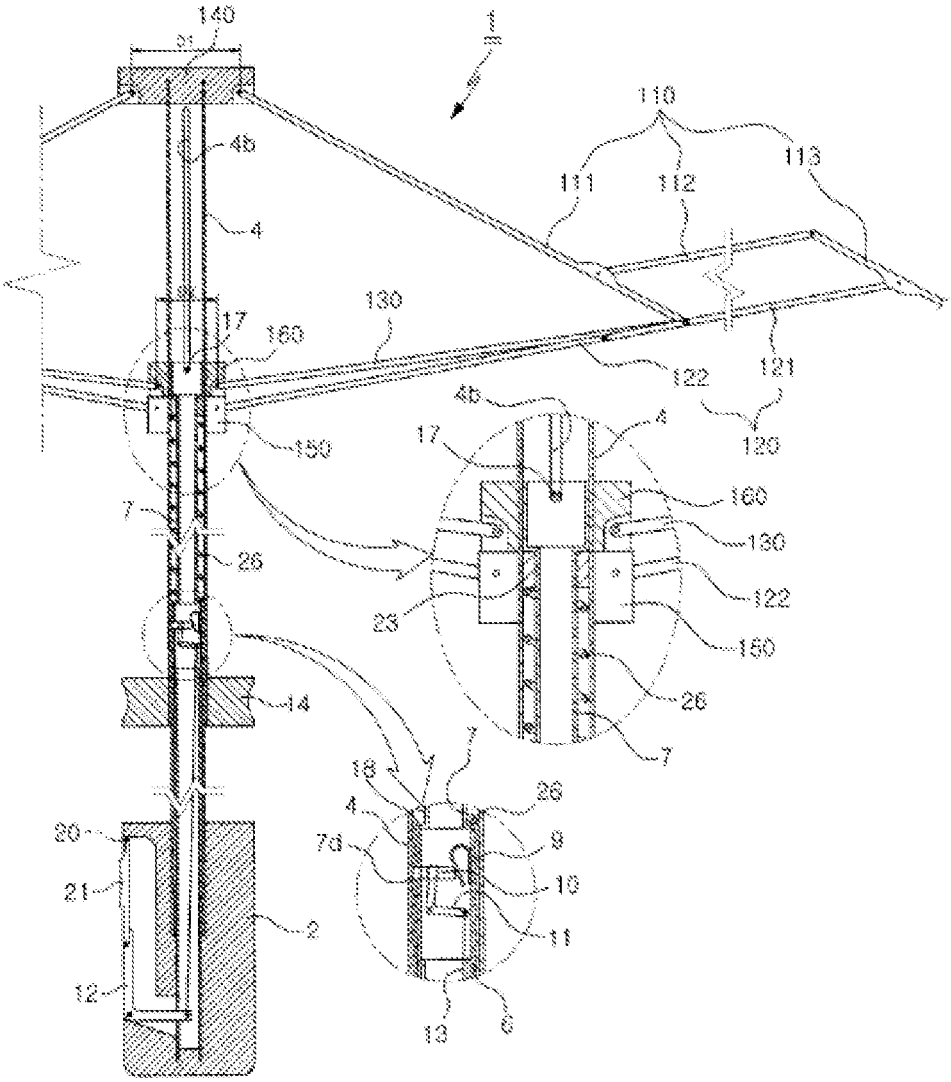
FIG. 10 is a view illustrating a state that an umbrella rib assembly of a telescopic umbrella is unfolded according to a third embodiment of the present invention.
Figure 11:
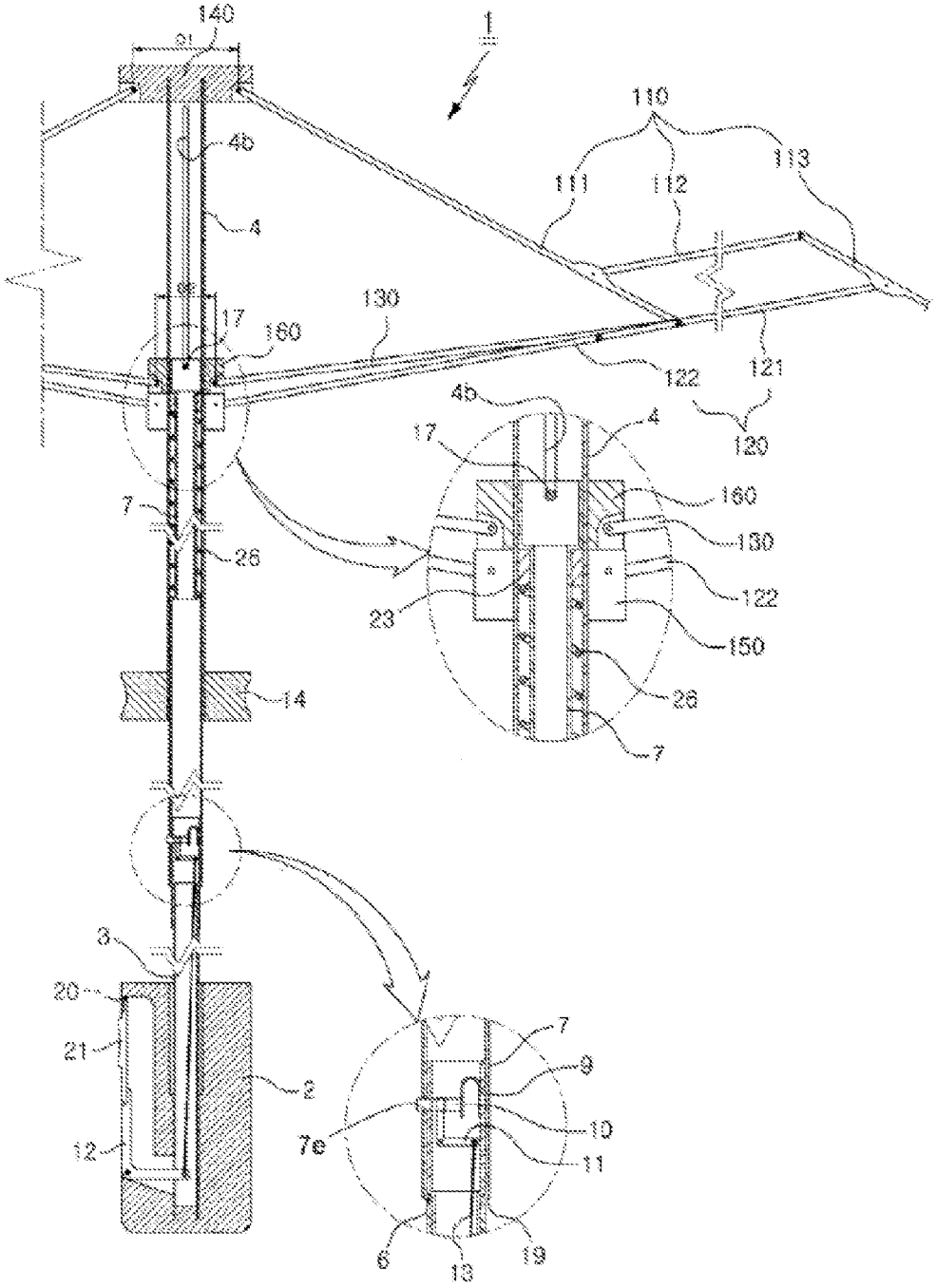
FIG. 11 is a cross sectional view illustrating a state that a telescopic umbrella is unfolded according to a third embodiment of the present invention.

FIG. 9 is a cross sectional view illustrating a state that a telescopic umbrella is folded according to a third embodiment of the present invention. FIG. 10 is a view illustrating a state that an umbrella rib assembly of a telescopic umbrella is unfolded according to a third embodiment of the present invention. FIG. 11 is a cross sectional view illustrating a state that a telescopic umbrella is unfolded according to a third embodiment of the present invention.

The telescopic umbrella 1 according to a third embodiment of the present invention is characterized in that it can be automatically unfolded and can be manually folded. As shown in the above drawings, the lower tube 3 is side-possibly inserted into the interior of the operation tube 7 having the contraction engaging shoulders 18 and 19 at its upper, intermediate side and the lower side, the lower side of the lower tube 3 being fixedly engaged at the grip 2, and the expanded engaging shoulder 6 being formed at the upper side of it. So, the upper side of the lower tube 3 and the expanded engaging shoulder 6 are caught by the contracted engaging shoulders 18 and 19 of the operation tube 7, respectively, the upper tube 4 with a relatively shorter length than the operation tube 7 is slide-possibly engaged to the outer side of it, thus finishing configuring the umbrella shank 5.

The latch 10 supported by the plate spring 9 is installed in the interior of the upper side of the expanded engaging shoulder 6 of the upper side of the lower tube 3, and the latch 10 is inserted into the fixing hole 4*c* formed at the intermediate portion of the upper tube 4 via the engaging hole 7*d* formed just below the contracted engaging shoulder 18 of the upper side of the operation tube 7 in a state that the umbrella 1 is folded, and in a state that the umbrella 1 is unfolded, it is inserted into the engaging hole 7*e* formed just above the contracted engaging shoulder 19 of the lower side of the operation tube 7.

The latch 10 is installed at the grip 2 in a rotatable way, and is installed to operate by means of the L-shaped button 12 rotating by means of the button 21 which recovers by means of the elastic force of the spring 20. The construction of it will be described. The L-shaped rotation member 11 one end of which is inserted into the hole 10*a* formed at the latch 10 for the latch 10 to move toward the plate spring 9 is rotatably pinned at the upper side the lower tube 3, and the end of the other side of the L-shaped rotation member 11 is connected with the L-shaped button 12 via the wire 13. When the button 21 is pressed, the latch 10 operates in sync, thus pressurizing the plate spring 9, and it is inserted into the interior of the lower tube 3, the construction of which so far described is same as the second embodiment of the present invention.

The operation grip 14 is fixed at the lower side of the upper tube 4, and the operation handle 14 is a member used when folding the umbrella 1.

At the upper side of the upper tube 4 is installed the umbrella rib assembly 100 according to the present invention. The construction of it will be described. At the upper side of the upper tube 4 is fixedly installed the main rib fixing member 140 to which the inner member 111 of the main rib 110 is rotatably engaged, and at an outer side of the upper tube 4 of the lower side of it is fixedly installed the first auxiliary rib fixing member 150 to which the support member 122 of the first auxiliary rib 120 is rotatably engaged, and between the main rib fixing member 140 and the first auxiliary rib fixing member 150 is installed the second auxiliary rib fixing member 160 to which the second auxiliary rib 130 is rotatably engaged. When the second auxiliary rib fixing member 160 descends toward the first auxiliary rib fixing member 150, the umbrella rib assembly 100 is unfolded, and when it ascends toward the main rib fixing member 140, the umbrella rib assembly 100 is folded.

At the upper tube 4 is formed the operation elongating hole 4*b* being opposite to it and being formed as much as the ascent and descent width of the second auxiliary rib fixing member 160, and the second auxiliary rib fixing member 160 is assembled to the upper side of the operation tube 7 by way of the pin 17 via the operation elongating hole 4*b*, so it can slide along the upper tube 4.

As for the construction that the umbrella 1 can be automatically unfolded according to the present invention, as a means for implementing it, there is provided a spring support 23 at the inner side of the first auxiliary rib fixing member 150 fixed at the upper tube 4, and the compression spring 26 is disposed between the contracted engaging shoulder 18 of the upper side of the operation tube 7 and the spring support 23.

The compression spring 26 is compressed and fixed at the time the umbrella 1 is folded, and it is used again when unfolding the umbrella 1.

The operations of the telescopic umbrella 1 according to a third embodiment of the present invention will be described.

When it is needed to unfold the umbrella 1 in a state that the umbrella 1 is folded as shown in FIG. 9, the button 21 installed at the grip 2 is pressurized.

When the button 21 is pressurized in the above manner, the L-shaped button 12 rotates, and the L-shaped rotation member 11 connected with it via the wire 13 rotates, and the latch 10 escapes from the fixing hole 4*c* and the engaging hole 7*d* overlapping with the intermediate portion of the upper tube 4 and the operation tube 7. At this time, the compression spring 26 disposed between the contracted engaging holder 18 of the upper side of the operation tube 7 and the spring support 23 expands, so the operation tube 7 is pushed and moves downward, and the second auxiliary fixing member 160 assembled with the upper side of the operation tube 7 by way of the operation elongating hole 4*b* via the pin 17 moves downward toward the first auxiliary rib fixing member 150, thus unfolding the umbrella rib assembly 100.

In a state that the umbrella rib assembly 100 is unfolded by means of the expansion force of the compression spring 26, only the operation tube 7 moves downward in case of the umbrella shank 5, and the lower tube 3 is not drawn from the operation tube 7 as shown in FIG. 10. In this state, it is needed to hold the grip 2 and to pull it downward for selectively drawing out the lower tube 3 from the operation tube 7.

In other words, when pulling it downward correctively, the air resistance force is applied to the umbrella cloth, and on the contrary, the lower tube 3 to which an attractive force is applied, is drawn downward. The lower tube 3 is downwardly drawn out from the operation tube 7, so the latch 10 installed at the upper side of the lower tube 3 is inserted into the engaging hole 7*e* formed just above the contracted engaging shoulder 19 of the operation tube 7, so the lower tube 3 and the operation tube 7 are fixedly engaged, thus supporting the umbrella shank 5 in the unfolded state, so the umbrella 1 is fully unfolded in a state as shown in FIG. 11.

In the state of FIG. 10, the latch 10 keeps coming into contact with the inner side of the upper tube 4 via the engaging hole 7*d* of the operation tube 7. In this state, when selectively pulling the grip 2, the end portion of the latch 10 is rounded so that the latch 10 is not caught by the engaging hole 7*d*.

When it is needed to fold the umbrella 1 after it is used, the button 21 is pressurized, and the grip 2 is pushed toward the operation grip 14 while holding with a hand the operation grip 14 provided at the lower side of the upper tube 4.

When the button 21 is pressurized, the L-shaped button 12 rotates, and the L-shaped rotation member 11 connected with it via the wire 13 rotates, and the latch 10 escapes from the engaging hole 7*e* formed just above the contracted engaging shoulder 19 of the lower side of the operation tube 7, so the engagement of the lower tube 3 and the operation tube 7 is disengaged. At this time, when the grip 2 is pushed toward the operation grip 14, the lower tube 3 is inserted into the interior of the operation tube 7, and the upper side of the lower tube 3 pushes up the contracted engaging shoulder 18 of the upper side of the operation tube 7, and at the same time the second auxiliary rib fixing member 160 assembled to the upper side of the operation tube 7 by way of the pin 17 via the operation elongating hole 4*b* ascends toward the main rib fixing member 140, so the umbrella rib assembly 100 can be folded.

In addition, the compression spring 26 disposed between the contracted engaging shoulder 18 of the upper side of the operation tube 7 and the spring support 23 is compressed, and when the latch 10 is inserted into the fixing hole 4*c* of the upper tube 4 via the engaging hole 7*d* formed below the contracted engaging shoulder 18 of the upper side of the operation tube 7, the lower tube 3 and the upper tube 4 and the operation tube 7 are concurrently engaged and fixed, so the umbrella 1 becomes a folded state as shown in FIG. 9.

In case of the umbrella rib assembly 100 according to the present invention, as mentioned in the above, the diameter D1 of the engaging part to which the man rib 110 is engaged is larger than the diameter D2 of the engaging part to which the second auxiliary rib 130 is engaged, so even when the strength of the compression spring 26 is weak, the umbrella rib assembly 100 can be unfolded. Therefore, with a small force, it is possible to compress the compression spring 26 and to fold the umbrella rib assembly 100, as a result of which less work is needed.

Figure 12:
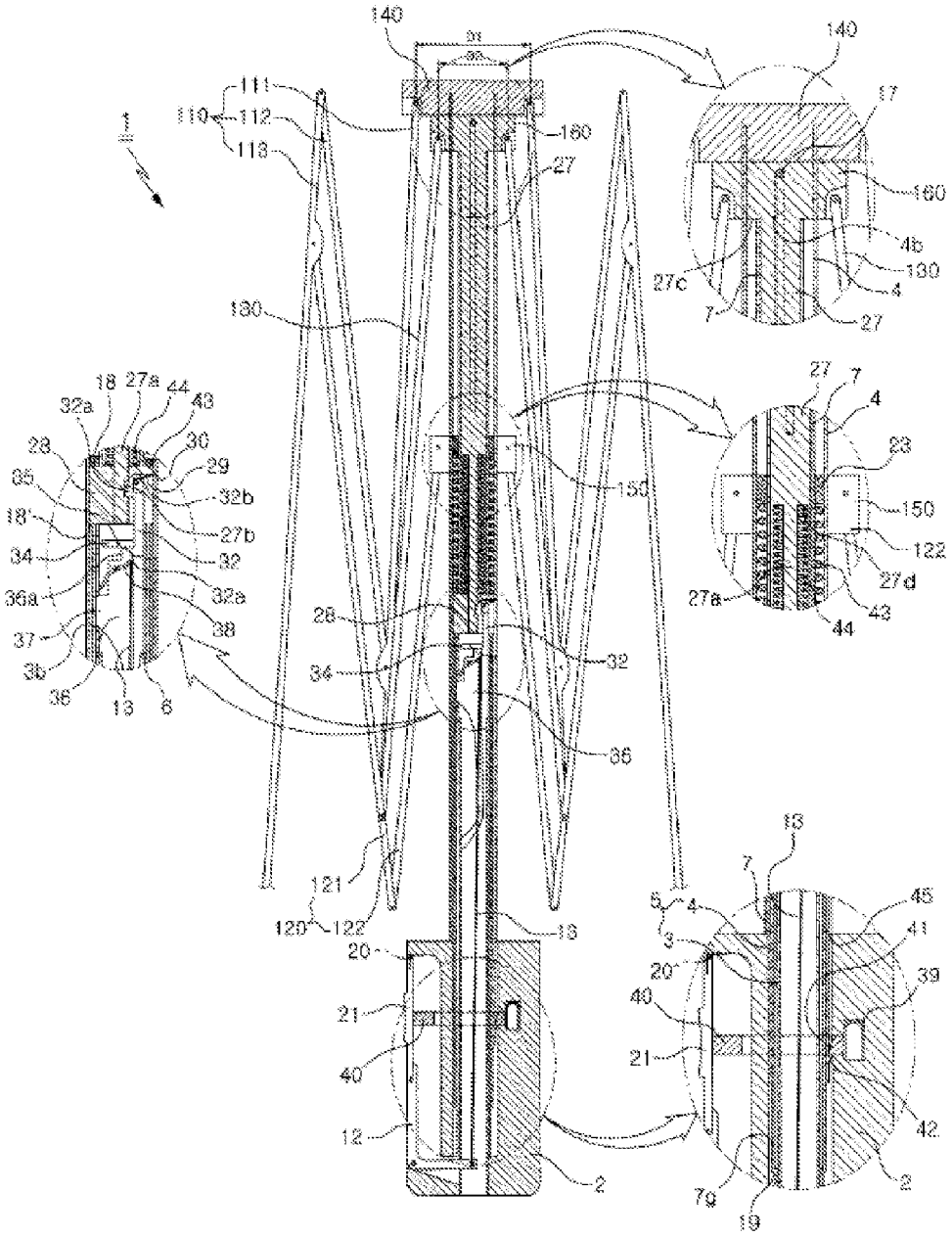
FIG. 12 is a cross sectional view illustrating a state that a telescopic umbrella is folded according to a fourth embodiment of the present invention.
Figure 13:
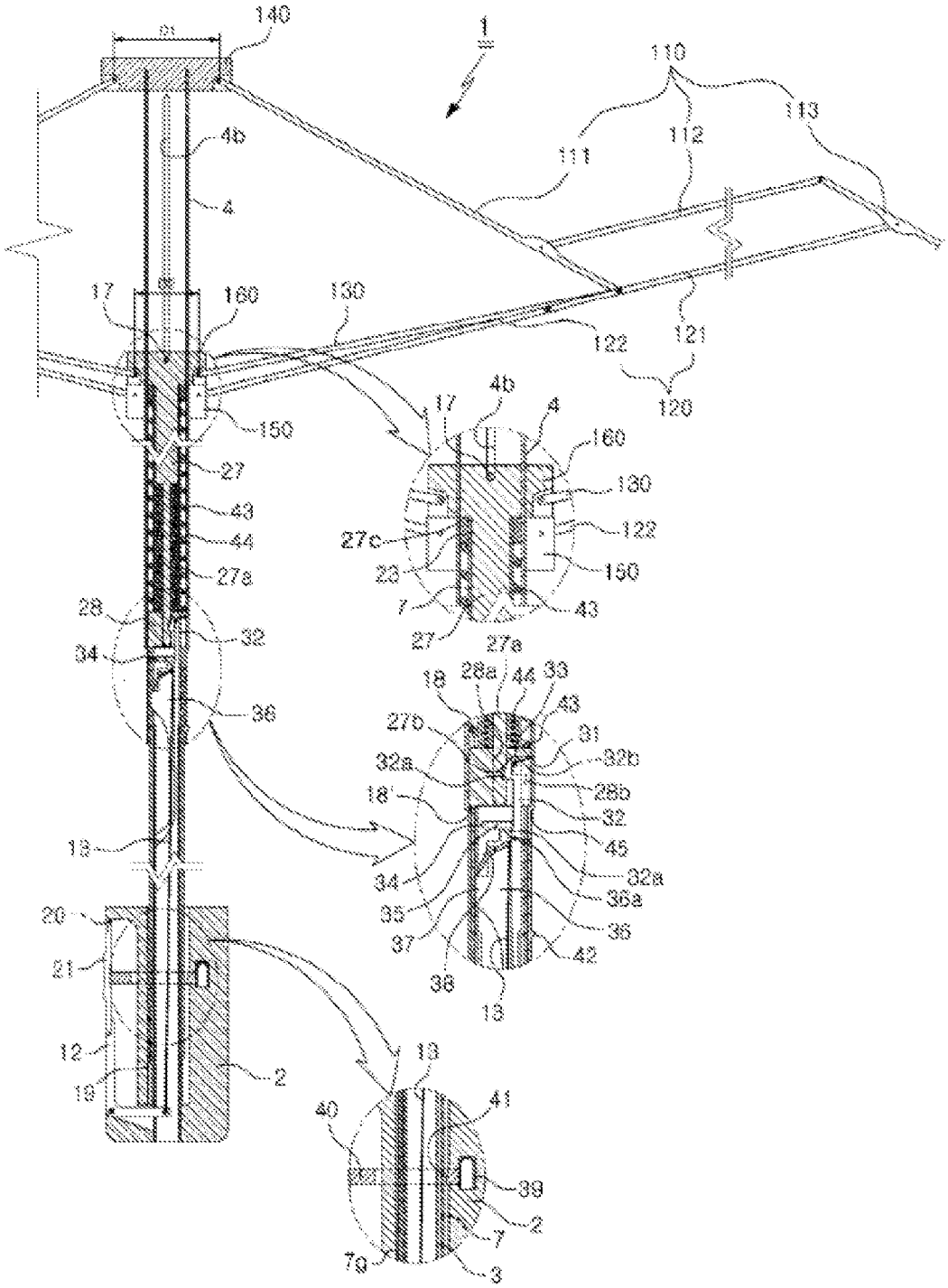
FIG. 13 is a view illustrating a state before an umbrella shank is drawn out in a state that an umbrella rib assembly of a telescopic umbrella is unfolded according to a fourth embodiment of the present invention.
Figure 14:
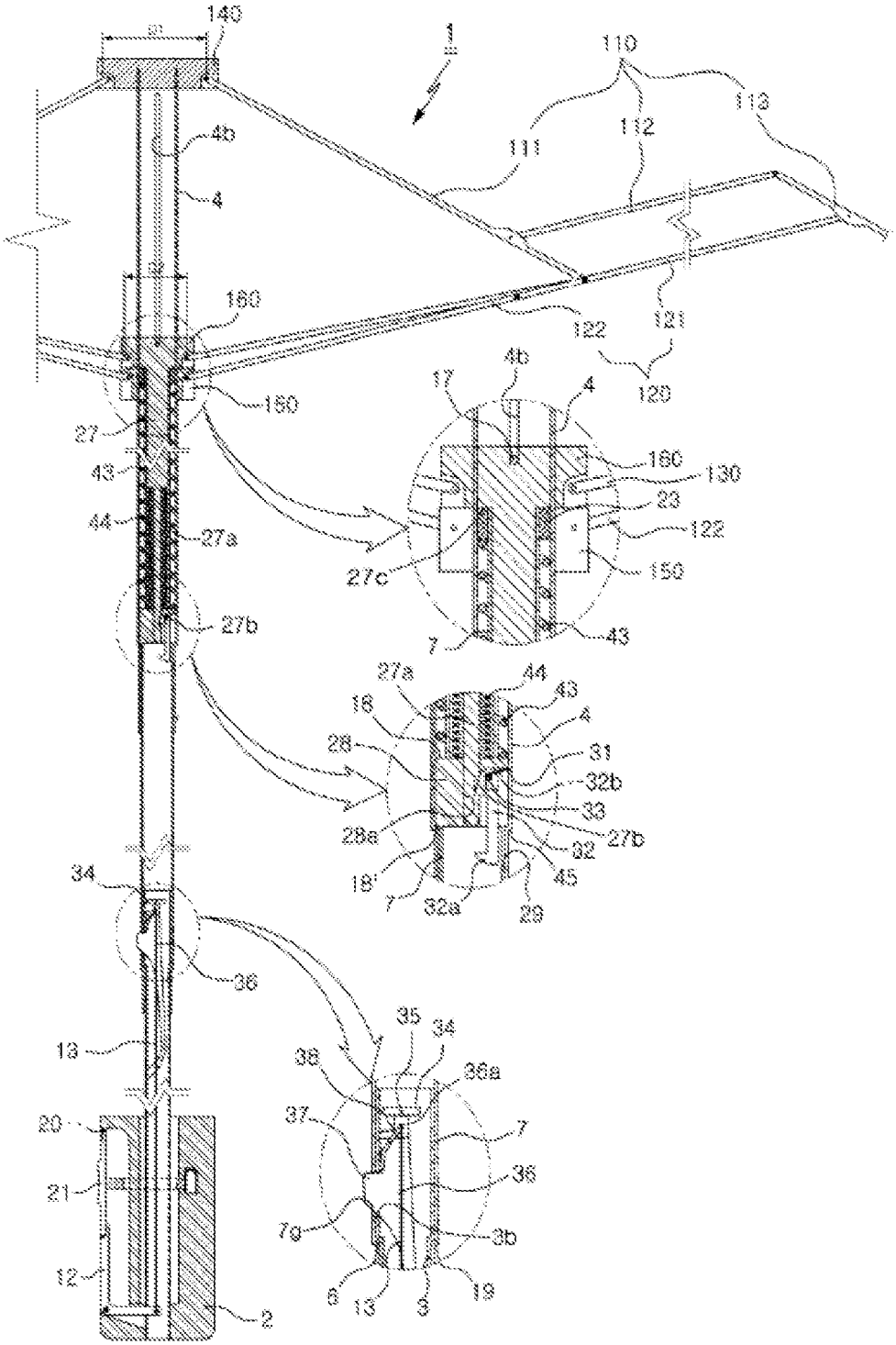
FIG. 14 is a view illustrating a state that an umbrella shank is drawn out in a state that an umbrella rib assembly of a telescopic umbrella is unfolded according to a fourth embodiment of the present invention.
Figure 15:
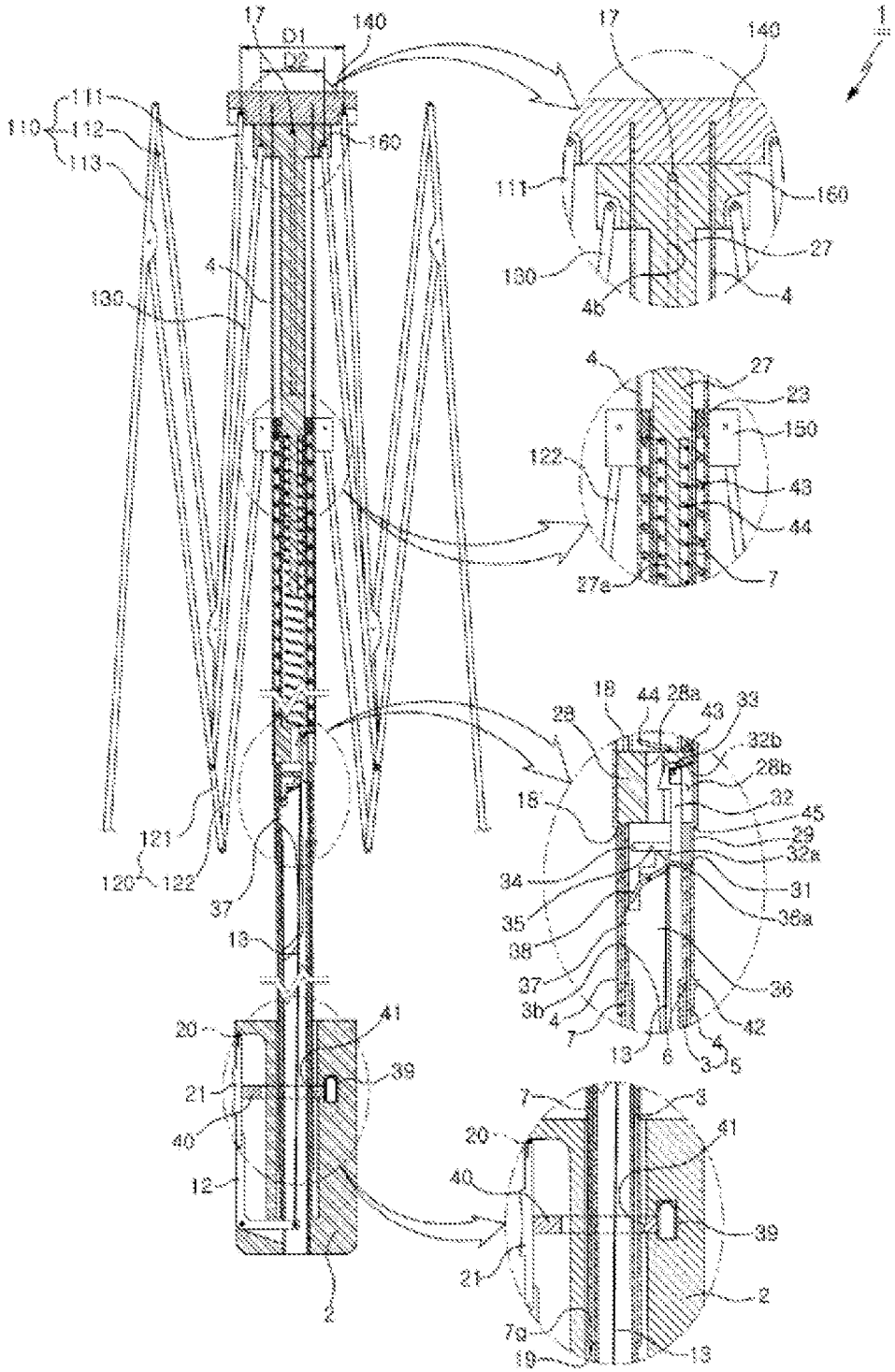
FIG. 15 is a cross sectional view illustrating a state that only the umbrella rib assembly of a telescopic umbrella is folded according to a fourth embodiment of the present invention.

FIG. 12 is a cross sectional view illustrating a state that a telescopic umbrella is folded according to a fourth embodiment of the present invention. FIG. 13 is a view illustrating a state before an umbrella shank is drawn out in a state that an umbrella rib assembly of a telescopic umbrella is unfolded according to a fourth embodiment of the present invention. FIG. 14 is a view illustrating a state that an umbrella shank is drawn out in a state that an umbrella rib assembly of a telescopic umbrella is unfolded according to a fourth embodiment of the present invention. FIG. 15 is a cross sectional view illustrating a state that only the umbrella rib assembly of a telescopic umbrella is folded according to a fourth embodiment of the present invention.

Figure 16:
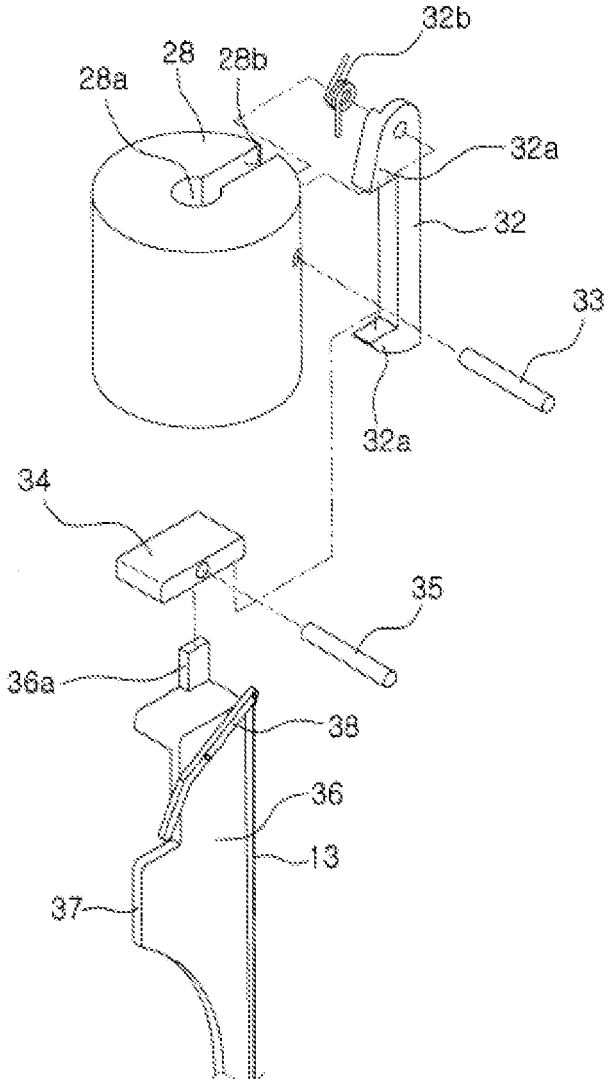
FIG. 16 is a perspective view illustrating a key portion to show a rotation part and a plate spring-assembled state according to a fourth embodiment of the present invention.
Figure 17:
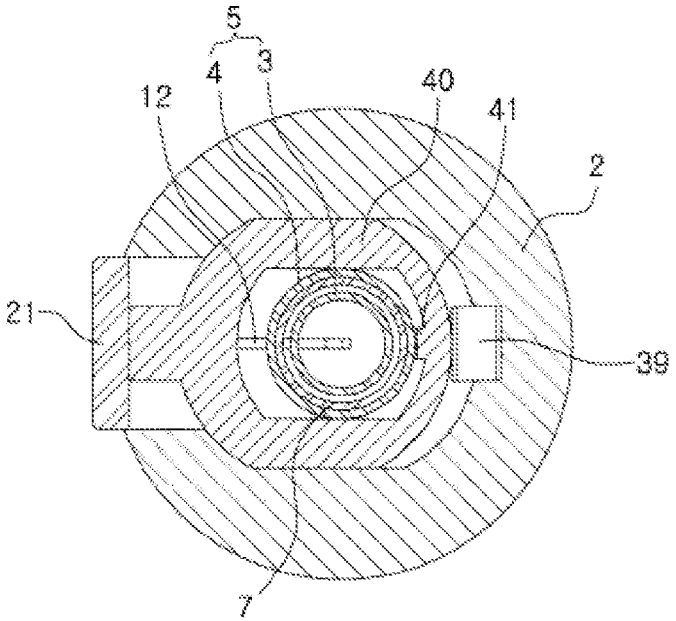
FIG. 17 is a plane cross sectional view illustrating a grip to show an engaging part-assembled state according to a fourth embodiment of the present invention.

FIG. 16 is a perspective view illustrating a key portion to show a rotation part and a plate spring-assembled state according to a fourth embodiment of the present invention. FIG. 17 is a plane cross sectional view illustrating a grip to show an engaging part-assembled state according to a fourth embodiment of the present invention.

The telescopic umbrella 1 according to a fourth embodiment of the present invention is directed to automatically unfold and fold the umbrella 1.

As shown in the above drawings, in the interior of the operation tube 7 in which the contracted engaging shoulder 19 is formed at the contracted engaging shoulders 18 and 18' of the upper and lower sides and the lower side at the intermediate portion, the lower tube 3 is inserted to be slide-possible, the lower end of the lower tube 3 being fixedly engaged at the grip 2, the upper end of it being formed on the expanded engaging shoulder 6, so the expanded engaging shoulder 6 of the lower tube 3 is caught by the contracted engaging shoulder 19 of the lower side of the operation tube 7, and the upper tube 4 with the contracted engaging shoulder 45 at the lower side is slide-possibly assembled to the outer side of it, the upper tube 4 being shorter than the operation tube 7, so the contracted engaging shoulder 18' of the operation tube 7 is caught by the contracted engaging shoulder 45 of the upper tube 4

The insertion hole 28*a* is formed, in a passing-through manner, at the center between the contracted engaging shoulders 18 and 18' formed at the upper side and the lower side of the intermediate portion of the operation tube 7, and the guide member 28 with a cut-away part 28*b* at one side is built-in, and the rotation part 32 is inserted into the cut-away part 28*b* of the guide member 28 for the purpose of being rotatable by means of the spring 32*b* via the rotation hole 29 formed at the operation tube 7 and two rotation holes 30 and 31 formed at the upper side and the lower side to match with the ascend and descent width of the operation tube 7 below the upper tube 4, so the upper side of the rotation part 32 is engaged at the guide member 28 using the pin 33, and at the rotation part 32 is formed the engaging protrusion 32*a* with the slanted surfaces, which are opposite to each other at the upper and lower sides and are positioned toward the insertion hole 28*a*. In addition, the expanded engaging shoulder 27*c* is formed at the upper side, and the contracted engaging shoulder 27*d* is formed at the intermediate, lower portion, so the upper side of the expanded engaging shoulder 27*c* comes into contact with the inner side of the upper tube 4, and the upper side of the contracted engaging shoulder 27*d* comes into contact with in the interior of the operation tube 7 for thereby assembling the auxiliary operation tube 27 which slides, and the engaging rod 27*a* is formed below the contracted engaging shoulder 27*d* of the auxiliary operation tube 27, and at the lower side of the engaging rod 27*a* is formed the engaging groove 27*b* caught by the engaging protrusion 32*a* of the upper side of the rotation part 32 as it is inserted into the insertion hole 28*a* of the guide member 28, so the operation tube 7 and the auxiliary operation tube 27 are connected.

Above the expanded engaging shoulder 6 of the upper side of the lower tube 3 is engaged a straight line shaped rotation member 34 by way of the pin 35 for the purpose of being caught by the engaging protrusion 32*a* of the lower side of the rotation part 32, and the plate spring 36 integrated with the engaging protrusion 37 is formed below the straight line shape rotation member 34, so the engaging protrusion 37 is drawn out of the hole 3*b* formed above the expanded engaging shoulder 6 of the lower tube 3, and in a state that the umbrella 1 is unfolded, it is inserted into the engaging hole 7*g* formed just above the contracted engaging shoulder 19 of the lower side of the operation tube 7. At the upper side of the plate spring 36 is bend-formed the straight line shaped support shoulder 36*a* which supports one side of the straight line shaped rotation member 34 without interfering with the rotation part 32, thus supporting the lower side of the straight line shaped rotation member 34 coming into contact with the engaging protrusion 32*a* of the lower side of the rotation part 32, and when the straight line shaped rotation member 34 rotates in the counterclockwise direction as it is caught by the engaging protrusion 32*a* of the lower side of the rotation part 32, it comes into contact with the side surface of the support shoulder 36*a* and can rotate as much as 90°.

In addition, the rotation lever 38 is arranged at the upper side of the plate spring 36, and its center is assembled by the pin, and the rotation lever 38 is characterized in that the side of the engaging protrusion 37 is lower, while coming into contact with the inner surface of the lower tube 3, and the opposite side is higher, with the end of it being rotatable about the grip 2, and via the wire 13 it is connected with the L-shaped button 12, which rotates by means of the button 21 recovering by the elastic force of the spring 20, so the engaging protrusion 37 formed at the plate sprig 36 is forced to insert into the inner side of the lower tube 3.

In the interior of the grip 2 is installed an engaging part 40 which is elastically supported by the plate spring 39 and has a protrusion 41, so the protrusion 41 is caught by the engaging protrusion 42 formed at the lower side of the upper tube 4, whereby it is possible to fix the umbrella 1 in a folded state, and when the button 21 is pressed, the protrusion 41 of the engaging part 40 escapes from the engaging protrusion 42, so the umbrella rib assembly 100 is unfolded.

At the upper side of the upper tube 4 is installed the umbrella rib assembly 100 according to the present invention. The above mentioned construction will be described. The main rib fixing member 140 to which the inner member 111 of the man rib 110 is rotatably engaged is fixedly installed at the upper side of the upper tube 4. At an outer side of the upper tube 4 of the lower side of the same is fixedly installed the first auxiliary rib fixing member 150 to which the support member 122 of the first auxiliary rib 120 is rotatably engaged, and the second auxiliary rib fixing member 160 to which the second auxiliary rib 130 is rotatably engaged is installed at between the main rib fixing member 140 and the first auxiliary rib fixing member 150 in a way to slide along the upper tube 4. When the second auxiliary rib fixing member 160 descends toward the first auxiliary rib fixing member 150, the umbrella rib assembly 100 is unfolded, and when it ascends toward the main rib fixing member 140, the umbrella rib assembly 100 is folded.

In addition, at the upper tube 4 is formed the operation elongating hole 4*b* being opposite to it and being formed as much as the ascent and descent width of the second auxiliary rib fixing member 160, and the second auxiliary rib fixing member 160 is assembled to the upper side of the auxiliary operation tube 27 with the pin 17 via the operation elongating hole 4*b*, so it can slide along the upper tube 4.

The present invention is directed to unfolding and folding automatically the umbrella 1. As a means to implement it, a spring support 23 is formed at an inner side of the first auxiliary rib fixing member 150 fixed at the upper tube 4, and a first compression spring 43 is disposed between the contracted engaging shoulder 18 of the upper side of the operation tube 7 and the spring support 23. As the button 21 is pressed, when the upper tube 4 becomes free from the engaging part 40 installed at the grip 2, the first compression spring 43 is expanded, and the umbrella rib assembly 100 is unfolded, and a second compression spring 44 is disposed between the guide member 28 and the contracted engaging shoulder 27*d* of the intermediate, lower side of the auxiliary operation tube 27 in a state that the engaging rod 27*a* is inserted in the interior of the operation tube 7. As the button 21 of the grip 2 is pressed, the engaging protrusion 37 of the plate spring 36 is inserted into the interior of the lower tube 3. When the engagement with the operation tube 7 is disengaged, the lower tube 3 is inserted into the interior of the operation tube 7 and is supported by the support shoulder 36*a* formed at the upper side of the plate spring 36, so the straight line shaped rotation member 34 in the horizontal state pushes the slanted surface of the engaging protrusion 32*a* of the lower side of the rotation part 32, thus rotating the rotation part 32. As a result, when the engagement between the operation tube 7 and the auxiliary operation tube 27 is disengaged and becomes free, it expands, so the umbrella rib assembly 100 can be folded.

The examples of the operations of the telescopic umbrella 1 according to a fourth embodiment of the present invention will be described.

When it is needed to unfold the umbrella 1, in a state as shown in FIG. 12, the button 21 installed at the grip 2 is pressed. As the button 21 is pressed in the above mentioned manner, the engaging part 40 caught by the engaging protrusion 42 is pressurized, so the protrusion 41 formed at the engaging part 40 escapes from the engaging protrusion 42, and the grip 2 and the upper tube 4 become free.

At this time, the first compression spring 43 disposed between the spring support 23 formed in the interior of the upper tube 4 and the contracted engaging shoulder 18 of the upper side of the operation tube 7 is expanded, and when the operation tube 7 moves downward, it is downwardly moved toward the auxiliary operation tube 27 engaged with the operation tube 7, and the second auxiliary rib fixing member 160 engaged to the upper side of the auxiliary operation tube 27 by way of the pin 17 via the operation elongating hole 4*b* of the upper tube 4 is downwardly moved toward the first auxiliary rib fixing member 150, so the umbrella rib assembly 100 is unfolded, and the state as shown in FIG. 13 is obtained.

The auxiliary operation tube 27 engaged with the second auxiliary rib fixing member 160 is downwardly moved in a state that it is fixed at the operation tube 7. When it is needed to draw out the umbrella shank 5 in a state that only the umbrella rib assembly 100 is unfolded as shown in FIG. 13, the grip 2 is held and selectively pulled downward.

An air resistance force is supplied to the umbrella cloth in a state that it is unfolded when selectively pulling downward the grip 2, and on the contrary, when an attractive force pulling the grip 2 is supplied to the lower tube 3, so the lower tube 3 is drawn out of the operation tube 7. At this time, the expanded engaging shoulder 6 formed at the upper side of the lower tube 3 descends close to the contracted engaging shoulder 19 of the lower side of the operation tube 7, and the engaging protrusion 37 integrated with the plate spring 36 is inserted into the engaging hole 7*g* formed just above the contracted engaging shoulder 19 of the lower side of the operation tube 7, and the lower tube 3 and the operation tube 7 are engaged, so the umbrella 1 is fully unfolded, and a state of FIG. 14 is obtained.

In a state that only the umbrella rib assembly 100 is unfolded, the straight line shaped rotation member 34 engaged to the upper side of the expanded engaging shoulder 6 of the upper side of the lower tube 3 via the pin 35 rotates in the counterclockwise direction as it is caught by the engaging protrusion 32*a* of the lower side when the grip 2 is pulled after it horizontally remains at the upper side of the engaging protrusion 32*a* of the lower side. Afterward, it comes into contact with the side surface of the support shoulder 36*a* formed at the upper side of the plate spring 36 and becomes vertical. In a state that the straight line shaped rotation member 34 becomes vertical, the selectively pulling down force is weak while the grip 2 is selectively pulled, the engaging protrusion 37 of the plate spring 36 is not caught by the engaging hole 7*g* formed just above the contracted engaging shoulder 19 of the lower side of the operation tube 7, so it retracts and does not come into contact with the engaging protrusion 32*a* of the lower side when the upper side of the lower tube 3 comes into contact with the contracted engaging shoulder 18' of the upper side of the operation tube 7, and as the rotation part 32 rotates, the engagement between the operation tube 7 and the auxiliary operation tube 27 is disengaged, so the umbrella rib assembly 100 is not folded. In addition, when the engaging protrusion 37 of the plate spring 36 is inserted into the engaging hole 7*g* of the lower side of the operation tube 7, the support shoulder 36*a* formed at the upper side of the plate spring 36 comes into contact with the side surface of the support shoulder 36*a* and pushes the lower side of the straight line shaped rotation member 34 which stands vertical, so it is used when folding the umbrella rib assembly 100.

When it is needed to fold the umbrella 1 after it is used, the button 21 installed at the grip 2 is pressurized again.

When the button 21 is pressurized, the L-shaped button 12 rotates by means of the button 21, and the rotation lever 38 connected with the L-shaped button 12 via the wire 13 is formed at the plate spring 36, thus allowing the engaging protrusion 37 caught by the engaging hole 7*g* formed just above the contracted engaging shoulder 19 of the lower side of the operation tube 7 to insert into the inner side of the lower tube 3 via the hole 3*b* formed just above the expanded engaging shoulder 6 of the lower tube 3. At this time, the lower tube 3 is inserted into the interior of the operation tube 7 by the weight itself. If it is not inserted by the weight itself, it is needed to selectively push the grip 2.

When the lower tube 3 is inserted into the operation tube 7, the slanted surface of the lower side of the engaging protrusion 32*a* of the lower side of the rotation pat 32 built-in between the contracted engaging shoulders 18 and 18' of the upper side of the operation tube 7 is supported by the support shoulder 36*a* and is pushed by the straight line shaped rotation member 34 which is in a horizontal state and rotates via the rotation holes 29 and 31 formed below the operation tube 7 and the upper tube 4. At this time, the engaging protrusion 32*a* of the upper side of the rotation part 32 escapes from the engaging groove 27*b* formed at the lower side of the engaging rod 27*a* of the auxiliary operation tube 27, so the engagement of the operation tube 7 and the auxiliary operation tube 27 is disengaged. At this time, the second compression spring 44 disposed between the guide member 28 and the contracted engaging shoulder 27*d* formed at the intermediate, lower side of the auxiliary operation tube 27 expands and pushes upward the auxiliary operation tube 27, so the second auxiliary rib fixing member 160 assembled to the upper side of the auxiliary operation tube 27 by way of the pin 17 via the operation elongating hole 4*b* ascends toward the main rib fixing member 140, thus folding the umbrella rib assembly 100.

When it is needed to fold the umbrella shank 5 in a state that the umbrella rib assembly 100 is folded, the grip 2 is pressurized in a state that the front of the upper tube 4, in other words, the portion at the side of the main rib fixing member 140 is supported against the wall or the floor is held by the other hand.

In other words, when the grip 2 is pressurized, the upper side of the lower tube 3 pushes upward the lower side of the guide member 28, and the is second compression spring 44 disposed between the guide member 28 and the contracted engaging shoulder 27*d* of the intermediate, lower side of the auxiliary operation tube 27 is compressed in a state that the first compression spring 43 disposed between the contracted engaging shoulder 18 of the upper side of the operation tube 7 and the spring support 23 is inserted in the engaging rod 27*a*, and the lower side of the engaging rod 27*a* is inserted into the insertion hole 28*a* of the guide member 28 to which the rotation part 32 is engaged, and the rotation part 32 rotates via the operation tube 7 and the rotation holes 29 and 30 formed at the upper side of the upper tube 4 and is inwardly inserted by means of the spring 32*b*, and the engaging protrusion 32*a* of the upper side of the rotation part 32 is inwardly inserted into the engaging groove 27*b* of the lower side of the engaging rod 27*a*, so the operation tube 7 and the auxiliary operation tube 27 maintain engaged, and at the same time the engaging protrusion 42 formed at the lower side of the upper tube 4 is caught by the protrusion 41 of the engaging part 40 installed at the grip 2, and the lower tube 3 and the upper tube 4 are fixedly engaged in a state that the first and second compression springs 43 and 44 are compressed, so the umbrella 1 is fully folded as shown in FIG. 12.

In case of the umbrella rib assembly 100 according to the present invention, the diameter D1 of the engaging part to which the main rib 110 is engaged as mentioned earlier is larger than the diameter D2 of the engaging part to which the second auxiliary rib 130 is engaged, so even when the strength of the compression springs 43 and 44 are weak, it is possible to unfold or fold the umbrella rib assembly 100, so it is not hard to concurrently compress the compression springs 43 and 44.

INDUSTRIAL APPLICABILITY

When the umbrella rib assembly and the telescopic umbrella according to the present invention are used, since the length is short in a state that the umbrella rib assembly is folded, which leads to an easier storage, and it is easy to unfold and fold the umbrella. The surface area of the umbrella cloth is wider as compared with the conventional telescopic umbrella, so the user's body can be protected from rain water in safe, which enhances the applicability in industry.

The invention claimed is:

1. An umbrella rib assembly (100), comprising:

a plurality of main ribs (110) each hinged at a main rib fixing member (140) provided at a top of an umbrella (1), the plurality of main ribs (110) being arranged along a circumferential direction of the main rib fixing member (140), each main rib (110) including:

an inner side member (111) having an inner end hinged by means of a pin at the main rib fixing member (140);

an intermediate member (112) having an inner end hinged by means of a pin at the inner side member (111) at a position higher than an outer end of the inner side member (111); and an outer side member (113) having an inner end hinged by means of a pin at an outer end of the intermediate member (112);

a plurality of first auxiliary ribs (120) each hinged at a first auxiliary rib fixing member (150) fixed to an umbrella shank (5) at a position lower than the main rib fixing member (140), the plurality of first auxiliary ribs (120) being arranged along a circumferential direction of the first auxiliary rib fixing member (150), each first auxiliary rib (120) including:

a support member (122) having an inner end hinged at the first auxiliary rib fixing member (150); and a connection member (121) arranged being substantially parallel with the intermediate member (112) and having an inner end hinged at an outer end of the support member (122), an outer end hinged at a position lower than the inner end of the outer side member (113), and a connection point at which an outer end of the inner side member (111) is hinged by means of a common pin positioned between the inner end of the connection member (121) and the outer end of the connection member (121); and a plurality of second auxiliary ribs (130) having an inner end hinged at a second auxiliary rib fixing member (160) slidable on the umbrella shank (5) between the main rib fixing member (140) and the first auxiliary rib fixing member (150), the plurality of second auxiliary ribs (130) being arranged in a circumferential direction of the second auxiliary rib fixing member (160) and an outer end hinged by means of the common pin at the connection point of the connection member (121) and the outer end of the inner side member (111), wherein a diameter (D1) of a first circle formed on the main rib fixing member (140) by the inner end of each inner side member (111) is larger than a diameter (D2) of a second circle formed on the second auxiliary rib fixing member (160) by the inner end of each second auxiliary rib (130), wherein the umbrella rib assembly (100) is unfolded when the second auxiliary rib fixing member (160) descends toward the fixed first auxiliary rib fixing member (150) while the umbrella rib assembly (100) is folded when the second auxiliary rib fixing member (160) ascends toward the fixed main rib fixing member (140).

2. A telescopic umbrella (1), comprising:

the umbrella rib assembly (100) of claim 1;

the umbrella shank (5) being expandable and retractable and on which the umbrella rib assembly (100) is mounted; and a grip (2) fixed to a lower end of the umbrella shank (5), wherein the umbrella shank (5) includes:

an operation tube (7) having a contracted engaging shoulder (8) at a lower portion thereof;

a lower tube (3) slidably inserted in the operation tube (7) and having a lower part on which the grip (2) is fixed and an expanded engaging shoulder (6) formed at an upper part of the lower tube (3), the upper part of the lower tube (3) having a slanted surface (3*a*) bent toward an inside of the lower tube (3) at a top of the lower tube (3), the expanded engaging shoulder (6) configured to be caught by the contracted engaging shoulder (8) when the lower tube (3) is extracted from the operation tube (7); and an upper tube (4) in which the operation tube (7) is slidably inserted, wherein the main rib fixing member (140) is fixed at an upper portion of the upper tube (4), the first auxiliary rib fixing member (150) is fixed to the upper tube (4) to be positioned under the main rib fixing member (140), and the second auxiliary rib fixing member (160) is mounted on the upper tube (4) and slidable between the main rib fixing member (140) and the first auxiliary rib fixing member (160);

wherein the umbrella shank (5) further includes:

a first plate spring (9) provided in the lower tube (3) at a position higher than the expanded engaging shoulder (6);

a latch (10) provided in the lower tube (3) and having an inner end supported by the first plate spring (9) in the lower tube (3), a hole (10*a*) formed in a longitudinal direction of the lower tube (3), and an outer end configured to be inserted into fixing holes (4*a*) or engaging holes (7*a*, 7*b*) formed at upper tube (4) or the operation tube (7) when the umbrella shank (5) is retracted or expanded;

an L-shaped rotation member (11) provided in the lower tube (3) and having a vertical end inserted in the hole (10*a*) of the latch (10) and a horizontal end connected by a wire (13) with an L-shaped button (12) rotatably installed at the grip (2), wherein the outer end of the latch (10) is released from the fixing holes (4*a*) or engaging holes (7*a*, 7*b*) when the L-shaped button (12) is pressed; and an operation grip (14) fixed at a lower end of the upper tube (4) and having a second plate spring (15) therein and a fixer (16) supported by the second plate spring (15) and protruded toward an inside of the upper tube (4), wherein the fixer (16) is inserted into another fixing hole (7*c*) of the operation tube (7) when the umbrella shank (5) are expanded, wherein the upper tube (4) includes an operation elongated hole (4*b*) formed along a longitudinal direction of the upper tube (4), and the second auxiliary rib fixing member (160) includes a guide pin (17) inserted in the operation elongated hole (4b) and guides a sliding movement of the second auxiliary rib fixing member (160) between the main rib fixing member (140) and the first auxiliary rib fixing member (150).

* * * * *